US012648661B2

(12) United States Patent
Carels

(10) Patent No.: US 12,648,661 B2
(45) Date of Patent: Jun. 9, 2026

(54) SAFETY INSERTION APPARATUS AND PARCEL BOX

(71) Applicant: YAYA B.V., Halfweg (NL)

(72) Inventor: Nikolai Rolf Carels, Haarlem (NL)

(73) Assignee: YAYA B.V., Halfweg (NL)

( * ) Notice: Subject to any disclaimer, the term of this patent is extended or adjusted under 35 U.S.C. 154(b) by 0 days.

(21) Appl. No.: 18/680,012

(22) Filed: May 31, 2024

(65) Prior Publication Data

US 2024/0341514 A1 Oct. 17, 2024

Related U.S. Application Data

(63) Continuation of application No. PCT/NL2022/050696, filed on Dec. 2, 2022.

(30) Foreign Application Priority Data

Dec. 2, 2021 (NL) ..... 2029998

(51) Int. Cl.
*A47G 29/20* (2006.01)
*A47G 29/124* (2006.01)

(52) U.S. Cl.
CPC ..... *A47G 29/20* (2013.01); *A47G 29/1248* (2017.08)

(58) Field of Classification Search
CPC ..... A47G 29/20; A47G 29/22; A47G 29/141; A47G 29/12095; A47G 29/1248; A47G 29/14; A47G 29/16; A47G 2029/1257; B65D 21/086; B65D 25/04; B65D 25/06
See application file for complete search history.

(56) References Cited

U.S. PATENT DOCUMENTS 1,111,031 A * 9/1914 Petri ..... A47G 29/12095 43/67
3,735,919 A * 5/1973 Morgan ..... A47G 29/121 232/17

(Continued)

FOREIGN PATENT DOCUMENTS

AU 2013203121 A1 5/2014
AU 2014203274 A1 1/2016

(Continued)

OTHER PUBLICATIONS

International Search Report and Written Opinion in corresponding International Application No. PCT/NL2022/050696 dated Feb. 6, 2023.

*Primary Examiner* — William L Miller
(74) *Attorney, Agent, or Firm* — Steven M. Koehler; Westman, Champlin & Koehler, P.A.

(57) ABSTRACT

An apparatus for one-way filling, in particular a secure reception box or a parcel box is provided. The apparatus comprises a tubular filling shaft having a filling end (F) for sequentially receiving multiple objects, in particular parcels (P1, P2, . . . ), in a filling direction (FD) within the shaft, and a plurality of dividers. Each divider is movably lockable or movably locked into the shaft and thus locked is movable in the filling direction (FD), closes off part of the shaft forming the thus closed off part into a compartment (C1, C2) for storing a received object, and prevents access, at least from the filling end (F) and in the filling direction (FD), to the respective compartment (C1, C2).

18 Claims, 27 Drawing Sheets

(56) References Cited

U.S. PATENT DOCUMENTS

| | | | | |
|---|---|---|---|---|
| 6,323,782 | B1 * | 11/2001 | Stephens | G07C 9/00571 340/5.73 |
| 6,756,879 | B2 * | 6/2004 | Shuster | G07F 17/13 700/214 |
| 7,051,921 | B1 * | 5/2006 | Borgognone | A47G 29/20 232/43.1 |
| 7,252,220 | B1 * | 8/2007 | Shreve | A47G 29/124 232/29 |
| 7,518,485 | B2 * | 4/2009 | Shuster | G06Q 10/08 340/5.73 |
| 9,504,344 | B2 * | 11/2016 | Sarvestani | A47G 29/1201 |
| 10,647,508 | B2 * | 5/2020 | Eck | B64F 1/368 |
| 10,968,023 | B2 * | 4/2021 | Alexander | G06Q 10/0832 |
| 11,131,138 | B2 * | 9/2021 | Wei | A47G 29/20 |
| 11,185,183 | B2 * | 11/2021 | Knox | A47G 29/141 |
| 11,253,094 | B1 * | 2/2022 | Deck | A47G 29/30 |
| 11,503,936 | B2 * | 11/2022 | Leng | A47G 29/1251 |
| 11,506,445 | B2 * | 11/2022 | Lubben | F25D 23/12 |
| 11,641,966 | B2 * | 5/2023 | Nakanishi | A47G 29/124 232/44 |
| 12,103,775 | B2 * | 10/2024 | Wilkinson | B65G 1/0421 |
| 12,280,913 | B2 * | 4/2025 | Gil | B64D 9/00 |
| 12,324,534 | B2 * | 6/2025 | Musaed | G06Q 10/0836 |
| 2004/0217157 | A1 * | 11/2004 | Swift | A47G 29/22 232/28 |
| 2011/0084123 | A1 * | 4/2011 | Cox | A47G 29/22 232/28 |
| 2013/0264381 | A1 * | 10/2013 | Kim | G07F 17/13 232/24 |
| 2016/0066732 | A1 * | 3/2016 | Sarvestani | A47G 29/141 232/24 |
| 2016/0257423 | A1 * | 9/2016 | Martin | A47G 29/14 |
| 2018/0092484 | A1 * | 4/2018 | Lewis | G08G 5/54 |
| 2018/0310714 | A1 * | 11/2018 | Becker | B65D 43/16 |
| 2018/0360178 | A1 * | 12/2018 | Bungert | B65D 25/04 |
| 2019/0313826 | A1 * | 10/2019 | Bickford | B65D 15/22 |
| 2019/0343317 | A1 * | 11/2019 | Cantrell | G07C 9/00563 |
| 2019/0368259 | A1 * | 12/2019 | Wei | E05B 37/0031 |
| 2020/0260896 | A1 * | 8/2020 | Leng | A47G 29/1251 |
| 2020/0281386 | A1 * | 9/2020 | Knox | A47G 29/22 |
| 2020/0317446 | A1 * | 10/2020 | Tovey | G06K 7/1417 |
| 2021/0304539 | A1 | 9/2021 | Simms et al. | |
| 2022/0055770 | A1 * | 2/2022 | O'Toole | B65G 69/003 |
| 2022/0306344 | A1 * | 9/2022 | Gil | B64D 1/08 |
| 2023/0200578 | A1 * | 6/2023 | Chhina | A47G 29/1251 232/24 |
| 2023/0363562 | A1 * | 11/2023 | O'Toole | A47G 29/16 |
| 2024/0002115 | A1 * | 1/2024 | Chernykh | B65D 51/18 |
| 2024/0268590 | A1 * | 8/2024 | Musaed | A47G 29/141 |
| 2025/0148857 | A1 * | 5/2025 | Ecton | G07F 17/13 |
| 2025/0214749 | A1 * | 7/2025 | Gil | B65D 25/06 |

FOREIGN PATENT DOCUMENTS

| | | | | |
|---|---|---|---|---|
| CH | 597810 | A3 | 4/1978 | |
| CN | 108669844 | A | 10/2018 | |
| DE | 102018001475 | A1 | 8/2019 | |
| EP | 2241225 | A1 | 10/2010 | |
| EP | 2241226 | A1 | 10/2010 | |
| GB | 2422871 | A | 8/2006 | |
| GB | 2430608 | A * | 4/2007 | A47G 29/141 |
| GB | 2443634 | A * | 5/2008 | A47G 29/20 |
| GB | 2510575 | B | 4/2017 | |
| GB | 2566281 | A | 3/2019 | |
| JP | H09-117366 | A | 5/1997 | |
| WO | 2021195516 | A1 | 9/2021 | |

* cited by examiner

SAFETY INSERTION APPARATUS AND PARCEL BOX

CROSS-REFERENCE TO RELATED APPLICATION

This application is a Continuation of International Application No. PCT/NL2022/050696, filed Dec. 2, 2022 and published as WO 2023/101555 A1 on Jun. 8, 2023, in English, and claims priority of Netherlands patent application 2029998, filed Dec. 2, 2021, both of which are incorporated by reference in their entireties.

FIELD

The present disclosure relates to a safety insertion apparatus. In particular, an apparatus for one-way filling, such as a secure reception box or a parcel box is provided. The apparatus comprises a tubular filling shaft having a filling end for sequentially receiving multiple objects, in particular parcels, in a filling direction within the shaft.

BACKGROUND

Parcel reception boxes and mailboxes allowing insertion of objects into the box but preventing unauthorised access and/or removal, without relying on electronic surveillance and/or actuation, are known.

Generally, such boxes rely on swinging doors and/or chutes, e.g., see GB 2422871 A, GB 2510575 B, GB 2566281 A, AU 2013/203121 A1. Further, CH 597810 A5, EP 2 241 225 A1 and EP 2 241 226 A1 disclose a parcel box suitable for receiving and keeping a single parcel in a theft-proof manner, if and when the parcel is heavy enough to activate a locking system. Some known parcel boxes are expandable to accommodate large shipments and/or differently shaped parcels, e.g., see AU 2014/203274 and JP H09-117366 A.

It has been found that existing safety parcel boxes tend to have several drawbacks, e.g.: they require significant space for the locking mechanism whereas the storage space is comparably small; they comprise a locking system which relies on activation by the parcel itself, which requires certain parcel properties for the activation, in particular requiring a minimum parcel weight; they can only accept a parcel once before requiring authorised access for emptying, thus preventing (use for) a subsequent delivery; in case they can accept parcels in multiple instances (multiple deliveries) they do not reliably close off the storage space after the first and/or the subsequent instance; introducing a parcel into a parcel box may entail dropping the parcel into the storage space which may cause damage to a delicate parcel, or its contents, from the fall itself and/or which may cause damage to an earlier received parcel and/or its contents, onto which the (subsequently inserted) parcel falls.

Therefore, further improvements in the field of parcel reception boxes and mail containers are desired. Similar considerations may apply to safety deposit boxes and other one-way insertion apparatus.

SUMMARY

In view of the above, herewith is provided an apparatus for one-way filling, in particular a secure reception box or a parcel box. The apparatus comprises a tubular filling shaft having a filling end for sequentially receiving multiple objects, in particular parcels, in a filling direction within the shaft, and a plurality of dividers.

Each divider of the plurality of dividers is movably lockable or movably locked into the shaft. Thus locked, each divider is movable in the filling direction, closes off part of the shaft forming the thus closed off part into a compartment for storing a received object, and prevents access, at least from the filling end and in the filling direction, to the respective compartment.

By the locking the dividers to the shaft and dividing the shaft into separate compartments closed off by the thus locked dividers, multiple objects may be received and stored securely, and unauthorised access to the previous object may be prevented. By providing plural dividers, plural such compartments may be formed and plural objects may be stored securely in the shaft. By the movability of the dividers in filling direction, a formed compartment may be sized in accordance with the object to be stored in it, so that volume of the shaft may be preserved for reception and storage of further objects in further compartments. Further, since a compartment once closed need not be opened again for receiving a subsequent object, the dividers may be of relatively simple construction and no space need be reserved for opening, in particular no space in the shaft.

The tubular shaft may don to a container and/or be part of a container itself. In particular, the shaft may be closed in the filling direction, e.g. with a bottom wall, so that one enclosed compartment may be formed by the shaft and a first divider locked into the shaft.

The filling end may preferably be formed as an end of the shaft. The shaft may preferably be sized for receiving mail-size parcels. Typically, mailed objects up to about 37×26×3 cm and up to 2 kg in weight may be considered as regular mail, and larger objects are considered mail-size parcels; mail size parcels may have sizes of up to 175×78×58 cm and up to about 30 kg in weight. A parcel box could therefore be sized to accommodate one or more such parcels. However, most mailed parcels are substantially smaller than such maximum size. It is considered that a parcel box having a shaft sized for receiving parcels of up to about 75×50×50 cm or up to about 50×35×50 cm can accommodate most mailed parcels and in particular may accommodate up to three average parcels.

The shaft and/or one or more of the dividers may be formed substantially aperture-free and/or opaque, for minimizing visibility and/or accessibility of a compartment formed by the shaft and such divider. However, one or more openings in a divider and/or between a divider and at least part of the shaft for ventilation may be provided if so desired, also facilitating movement of the divider by preventing air pressure build-up in the compartment at least partly defined by such divider. One or more, preferably each, compartment may be enclosed on all sides, e.g. having one or more circumferential walls and opposite end walls, such as having three pairs of mutually opposite walls.

At least one, preferably all, of the plurality of dividers may be movably lockable or locked to the shaft at or near the filling end. Thus, interior volume of the shaft used, or at least usable, for locked storage compartments may be optimised. Further, inspection of the shaft may provide little to no information about a size and/or number of any objects in the shaft behind the divider(s).

The apparatus may comprise one or more latches for locking a divider to the shaft. Latches may facilitate locking a divider to the shaft. At least one of such latches may comprise an at least partly resilient member, which may provide snap lock latching.

At least one, preferably all, of the plurality of dividers and/or the shaft may comprise one or more such latches for the locking. In particular, at least one, preferably all, of the plurality of dividers may comprise one or more latches and the shaft may then comprise one or more matching engagement portions. By providing the dividers with the one or more latches, the shaft may be constructed relatively simple. Also or alternatively, maintenance and/or repair may be facilitated by removal of a divider for improving access to the divider and/or for replacement of the divider. Further, as also explained below, such construction may facilitate (authorised) unlocking of a divider from the shaft. Reliability of such latching and/or of definition of one or more particular relative positions may be improved by providing engagement portions matching the latches.

The one or more latches, and possibly the one or more matching engagement members, when present, may allow movement of a divider locked to the shaft in the filling direction but prevent movement in opposite direction. Thus, a divider may be inserted further into the shaft but access to and/or removal of the divider may be prevented more and/or better than if movement in the opposite direction were allowed and locking is limited to a single position.

Allowing movement in the filling direction but prevention of movement in the other direction may be provided by a ratchet-and-pawl mechanism, but other mechanisms may also be provided.

In some embodiments, the apparatus may be configured for releasably holding a divider in at least one predetermined position relative to the shaft when movably locked to the shaft. The at least one predetermined position may be at or near the filling end. Holding the divider in the predetermined position may facilitate entering objects into the shaft. It may further prevent a divider from falling into a vertically arranged shaft. Also or alternatively, it may assist in obscuring information regarding size, number, appearance etc. of one or more objects which was/were introduced into the shaft earlier and/or which is/are contained behind the divider.

Then, at least one, preferably all, of the plurality of dividers and the shaft may comprise cooperating magnetic and/or magnetisable elements for releasably holding the divider in at least one of the predetermined positions relative to the shaft. Magnetism provides a reliable force for attracting objects and maintaining such objects in a particular (relative) position, without requiring an energy source and/or without (noticeable) weakening. Further, the magnetic holding strength and a force for "breaking" the hold and moving the divider may be reliably determined.

Movement of the dividers movably locked to the shaft may be substantially limited to translation within the shaft, in particular translation in the filling direction. In particular, the shaft and dividers may comprise one or more guide structures such as one or more rails. By restricting the movement to translation, in particular along an axis of the shaft and/or in particular in case of a straight shaft, the divider can be made to fit closely in the shaft and space between the divider and the shaft may be prevented, which space might otherwise have allowed unauthorised access to the compartment behind the divider. Such unauthorised access might comprise (use of) tools, such as prying and/or hooking tools, and should preferably be prevented. Tilting of a divider will generally create or enlarge any space between a perimeter of the divider and an inner wall of the shaft perpendicular to an axis of rotation about which the divider is so tilted. Translation in the filling direction facilitates adjusting the size of the compartment defined by the divider as well as providing space for the next compartment.

Guide structures such as one or more rails may facilitate determining the direction of translation and/or prevention of tilting. Rails and possibly one or more cooperating sliders, rollers, trolleys, complementary rail(s), etc. may further facilitate prevention of rotation in plural directions (i.e. about plural axes of rotation). Also or alternatively, one or more rails may serve as part in and/or be combined with a locking arrangement. In particular, the shaft may comprise one or more rails and one or more dividers may comprise such cooperating sliders, rollers, trolleys, and/or complementary rail(s), which may form or provide at least part of the connection and/or locking mentioned elsewhere herein.

The apparatus may comprise a door, wherein opening and closing of the door, respectively, closes or opens access to the filling end, in particular in the filling direction. The door may close a compartment but generally does not form a divider as specified herein; the door should be openable repeatedly for providing access to the filling end for entering successive objects into the shaft. The door may provide the access in the filling direction, in accordance with (movability of) the dividers. The door may serve for protection against weather etc. for locations outside. The door may form a lid.

The apparatus may comprise a dispenser for sequentially dispensing the dividers.

Such dispenser may provide a controlled storage and/or provision of dividers and it may reduce or prevent losing of dividers. Dispensing dividers sequentially facilitates determining successive compartments. The dispenser may be comprised in one part of the apparatus or be provided by plural cooperating parts of the apparatus distributed in the shaft and a door. Possibly, the dispenser is arranged to operate in dependence of and/or associated with at least some part of a divider, e.g. one or more latches for engaging at least part of the shaft.

The dispenser may be arranged for, associated with dispensing at least one divider, movably locking the divider into the shaft.

Such dispenser may in particular reduce or prevent losing of dividers. Also or alternatively, the dispenser may lock one or more, in particular each dispensed divider in at least one predetermined position relative to the shaft when movably locked to the shaft, wherein preferably the at least one predetermined position is at or near the filling end. Note that once a divider is moved in the filling direction for closing off part of the shaft forming a compartment, the aforementioned predetermined position may become available for a subsequent divider. Thus, the apparatus may provide consistent operation.

The dispenser may be configured for dispensing a divider associated with the opening and/or the closing of the door, preferably one divider per opening and/or closing. In such case, sequential filling of the shaft may be facilitated since opening and closing of the door may be in particular be associated with introduction of an object into the shaft, e.g. for therewith defining and closing a closed compartment. Dispensing one divider per opening and/or closing assist dosing the dispensing.

Also, dispensing of a divider may be prevented if no object has been introduced and when opening and/or closing the door; this may prevent inadvertently dispensing dividers. This may also or alternatively prevent that dividers are dispensed without being receivable into the shaft and/or without being (possible to be) locked to the shaft in which case the respective not-locked divider may become displaced and/or lost.

The dispenser may comprise a first part for holding one or more dividers, the dividers preferably being arranged in a stack, and a second part for releasing at least one of the one or more dividers held in the first part. Then the first part may comprise first coupling members for holding at least one of the dividers, e.g. one or more clamps and/or latches for engaging the at least one of the dividers. The second part may then comprise first decoupling members for decoupling the first coupling members, in particular being configured for engaging and detaching the one or more clamps and/or latches when engaging the at least one of the dividers. The first part of the dispenser may be closed so as to prevent access to the dividers. The dividers may be plate-like. Stacking of dividers, in particular plate-like dividers may reduce volume. The first part may be fixed with respect to the shaft, or it may be at least partly movable with respect to the shaft; in the latter case dispensing of a divider relative to the shaft and/or locking of the divider to the shaft may be facilitated. The second part and the first part may be movable with respect to each other. The second part may comprise a handle or a lever. However, a passive construction comprising cooperating portions engaging each other for decoupling the coupling members may be preferred. Such cooperating portions may comprise one or more bent and/or inclined surface portions.

The dispenser, and in particular the second part, may be operated substantially automatically associated with introduction of an object into the shaft, e.g. with opening of a door and/or with movement of a divider into the shaft causing dispensing of a subsequent divider.

Clamps and/or latches may facilitate holding one or more dividers in the first part. Configuring the second part to decouple the first coupling members may facilitate reliable operation of (the dispenser of) the apparatus.

In an embodiment comprising a door and a dispenser comprising a first part and a second part, the door may comprise the first part and the filling end may comprise the second part. Then in particular the dispenser may be configured such that in closed configuration of the door and the shaft, the first decoupling members decouple the first coupling members. Such apparatus facilitates use since it allows that with each closing and opening of the door a divider is dispensed. Thus, when closing the door after introduction of an article, a divider may be dispensed for defining and closing a compartment.

Note that in some cases apparatus may be configured so that the first decoupling members are configured to undo the decoupling and/or to recouple the first coupling members when a divider need not be dispensed and/or when a predetermined position into which the divider should have been dispensed is blocked, in particular being blocked by a previously dispensed divider which may cover one or more large parcels. This may prevent accidental and/or untimely dispensing of a (subsequent) divider, e.g. in case no object is inserted (after all).

The apparatus may comprise a second door. This door may facilitate emptying at least some compartments of the shaft, without requiring interaction with a locking system for locking a divider in and/or to the shaft. Also, different mechanisms for this second door and the above-referenced (first) door may be provided, allowing optimizing each of the doors for particular purposes. The second door may be provided with a lock and/or another system for preventing unauthorised access to at least some of the compartments and/or at least some of the dividers. Authorisation may require a suitable combination of a lock and one or more of a key, a code, and some other identifier, as set out elsewhere herein.

The apparatus may comprise a system for authorised unlocking and possibly decoupling the dividers from the shaft. In particular, the system for unlocking the dividers from the shaft may be controllably accessible, wherein access to the system may require authorisation. Then, once accessed the system may be free for operation. Thus, operation of the apparatus may be undone and/or the apparatus may be restored to operative condition, e.g. after at least partial emptying of at least some of the compartments. Requiring authorisation for the unlocking, and in particular the decoupling provides security against theft. Authorisation may require a suitable combination of a lock and one or more of a key, a code, and some other identifier. In particular, access authorisation may be provided by a locked or lockable door. E.g. any key and/or code referred to in this text may comprise a physical part (e.g. one or more of keys, tokens, dials, punch code buttons, etc.) and/or an electromagnetic part (e.g. relying on one or more of electronic-, magnetic-, optical-, and RFID-signals, which may require communication with a handheld device and/or a remote server possibly via the Internet, etc.). Also or alternatively identification on the basis of one or more biologic features could be used as at least part of such key and/or code, e.g. fingerprint and/or retina, etc.

The apparatus may comprise a door for accessing at least some of the compartments and/or at least some of the dividers from another direction than the filling direction, which door provides access to the system for authorised unlocking and possibly decoupling the dividers from the shaft. This door may be the second door mentioned before. Thus, construction of the apparatus may be simplified by integrating constructions. Also, the apparatus may be provided more robust.

Although the present concepts of provision of sequences of dividers to define sequences of compartments may be used for separating secure transport through the shaft, it is preferred that the apparatus comprises a bottom, the apparatus being formed as a container for stored objects. Thus a safe storage may be provided.

The apparatus may comprise a mail compartment for receiving mail, like a letter slot and/or a newspaper receptacle, since the apparatus may be formed for placement outside and/or the apparatus may be formed for receiving deliveries like mailed packages. Such mail compartment may be closed or closable against theft of received mail in one configuration and accessible for retrieval of received mail in another configuration.

An embodiment may then comprise a door for accessing at least some of the compartments and/or at least some of the dividers from another direction than the filling direction which door comprises at least part of the mail compartment. Thus, emptying of one or more compartments defined by a divider and emptying of the mail compartment may be combined.

BRIEF DESCRIPTION OF THE DRAWINGS

The above-described aspects will hereafter be more explained with further details and benefits with reference to the drawings showing a number of embodiments by way of example.

DETAILED DESCRIPTION OF ILLUSTRATIVE EMBODIMENTS

Figure 1:
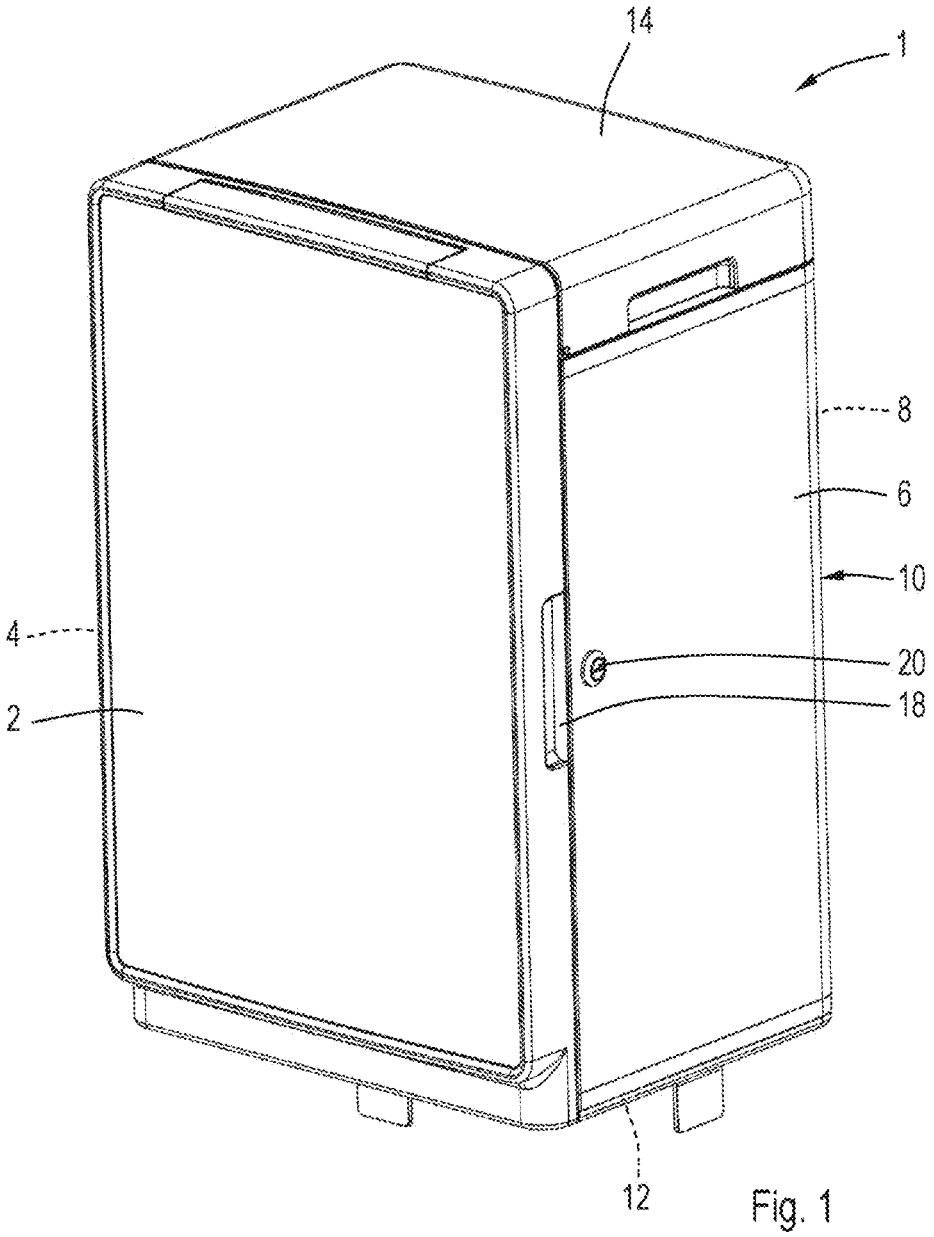
FIG. 1 shows a parcel box as an embodiment.

It is noted that the drawings are schematic, not necessarily to scale and that details that are not required for understanding the present invention may have been omitted. The terms "upward", "downward", "below", "above", and the like relate to the embodiments as oriented in the drawings, unless otherwise specified. Further, elements that are at least substantially identical or that perform an at least substantially identical function are denoted by the same numeral, where helpful individualised with alphabetic suffixes.

Further, unless otherwise specified, terms like "detachable" and "removably connected" are intended to mean that respective parts may be disconnected essentially without damage or destruction of either part, e.g. excluding structures in which the parts are integral (e.g. welded or moulded as one piece), but including structures in which parts are attached by or as mated connectors, fasteners, releasable self-fastening features, etc. The verb "to facilitate" is intended to mean "to make easier and/or less complicated", rather than "to enable".

FIG. 1-4 show a parcel box 1 (hereafter also briefly: "box") as an exemplary apparatus according to the concepts set out herein. The box 1 is generally tubular, here comprising four walls 2, 4, 6, 8, together forming a tubular shaft 10. The tubular shaft 10 is closed by a bottom wall 12 of the box 1, thus forming a container for objects such as parcels. As will be set out in more detail below, the box 1 further comprises a lid 14 as a door by which the shaft 10 can be opened and closed at a filing end F for introducing objects into the shaft 10 in a filling direction FD. For case of reference, the four walls 2, 4, 6, 8 of the box 1 may be called a front wall, side walls opposite each other, and a rear wall, respectively. On an inside of the side walls 4, 6, rail segments 15B, 15C are provided.

The box 1 is optionally provided with a (second) door 16 allowing sideways opening of at least part of the shaft 10 of the box 1. Here, as an option, the door 16 provides the front wall 2. The door 16 comprises a grip 18 and it is lockable against unauthorised opening, the box being provided with a lock 20 requiring a key (not shown). Due to the door 16, at least part of the contents of the shaft 10 may be accessed from another direction than the filling direction FD.

The shown shaft 10 is generally rectangular in cross section. However, other rectangular dimensions and/or other shapes altogether may be provided as well, e.g. a generally square or a generally rectangular shape with transverse length ratios of 1:2, 1:3, 1:4, 3:4, 1:5, 2:5, 3:5, etc. may be provided, as well as any other polygonal and/or at least partly rounded shape.

Figure 2:
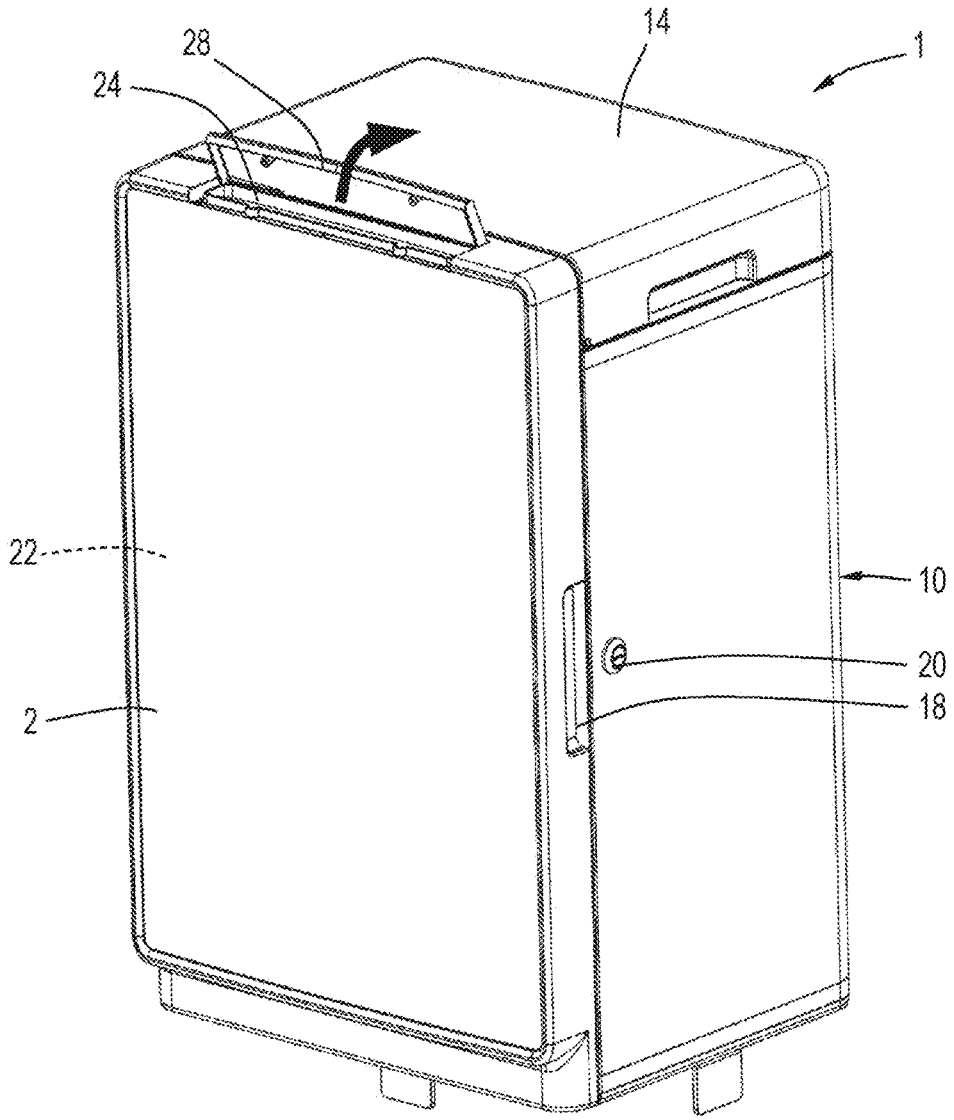
FIGS. 2-3 show use of the parcel box for receiving mail.
Figure 3:
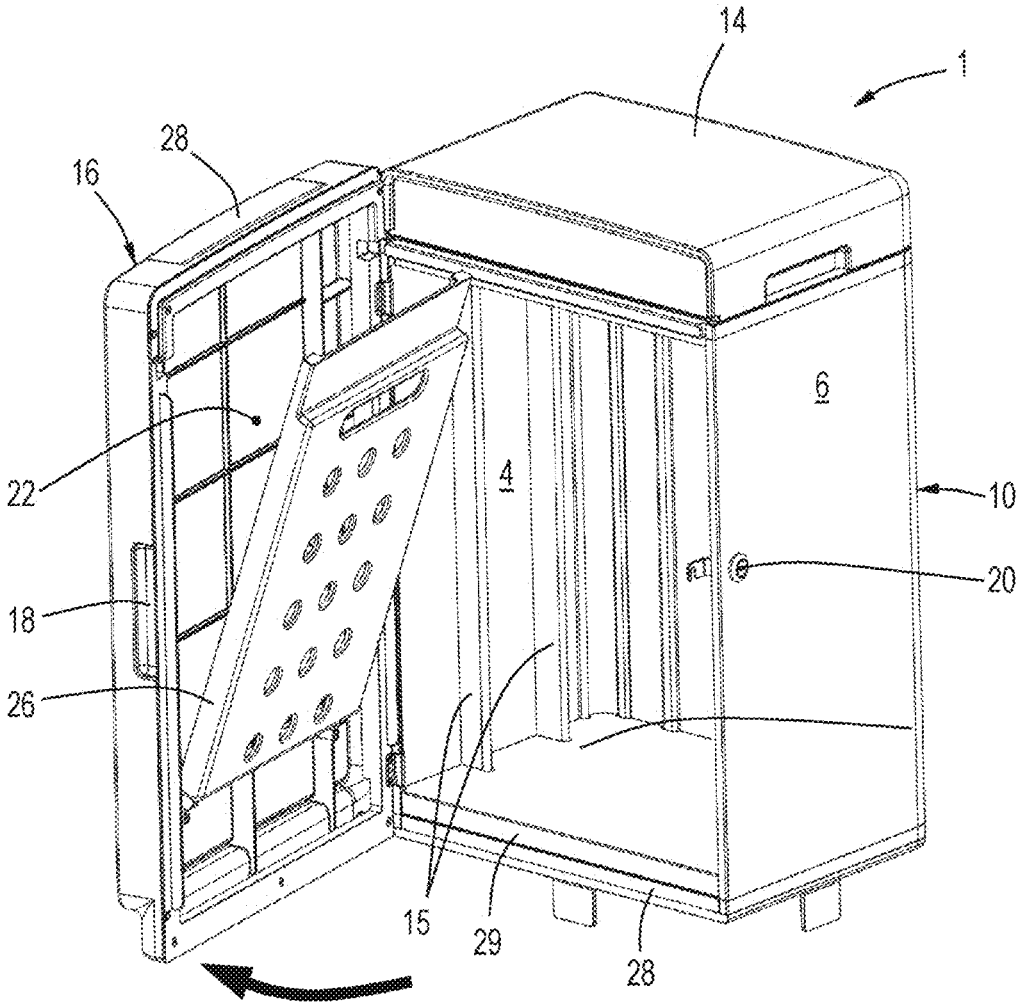

The box 1 comprises an optional mail compartment 22, integrated into the door 16. However, a mailbox could be mounted elsewhere in the box 1, e.g. in or on another wall. In the exemplary embodiment, the shown mail compartment 22 comprises a mail slot 24 and an optional receptacle 26 for receiving mail inserted into the mail slot 24, e.g. a box or a basket. The mail slot 24 is closable, e.g. against rain, by an optional lid 28 (FIG. 2). Received mail may be accessed when the door 16 is opened (FIG. 3). For ease of emptying at least part of the mail receptacle 26 may be one or more of movable, openable and/or deformable; in the shown embodiment the mail receptacle 26 comprises a rotary box tiltable from an upright reception position to a tilted emptying position (FIG. 3).

FIGS. 5-11 show introducing a parcel P1 into (the shaft 10 of) the box 1. Note that in FIGS. 6-10 the side door 16 is only shown in phantom, for clarity of the operation.

For introducing a parcel or other object into the shaft 10 the lid 14 should be opened. In the shown embodiment, the lid 14 is rotary, hinged to at least part of the remainder of the box 1, here to a side wall 4, by hinges 14H. The lid 14 may be closable and/or held closed (i.e. the shaft being closed by the lid, the lid hindering access to the interior of the box) by gravity and/or by a closure mechanism such as one or more of latches, springs, levers, magnets, etc. (not shown) Although it is preferred that the lid 14 is openable without authorisation requirement, the lid may be lockable against accidental and/or unauthorised opening like the door 16.

Figure 5:
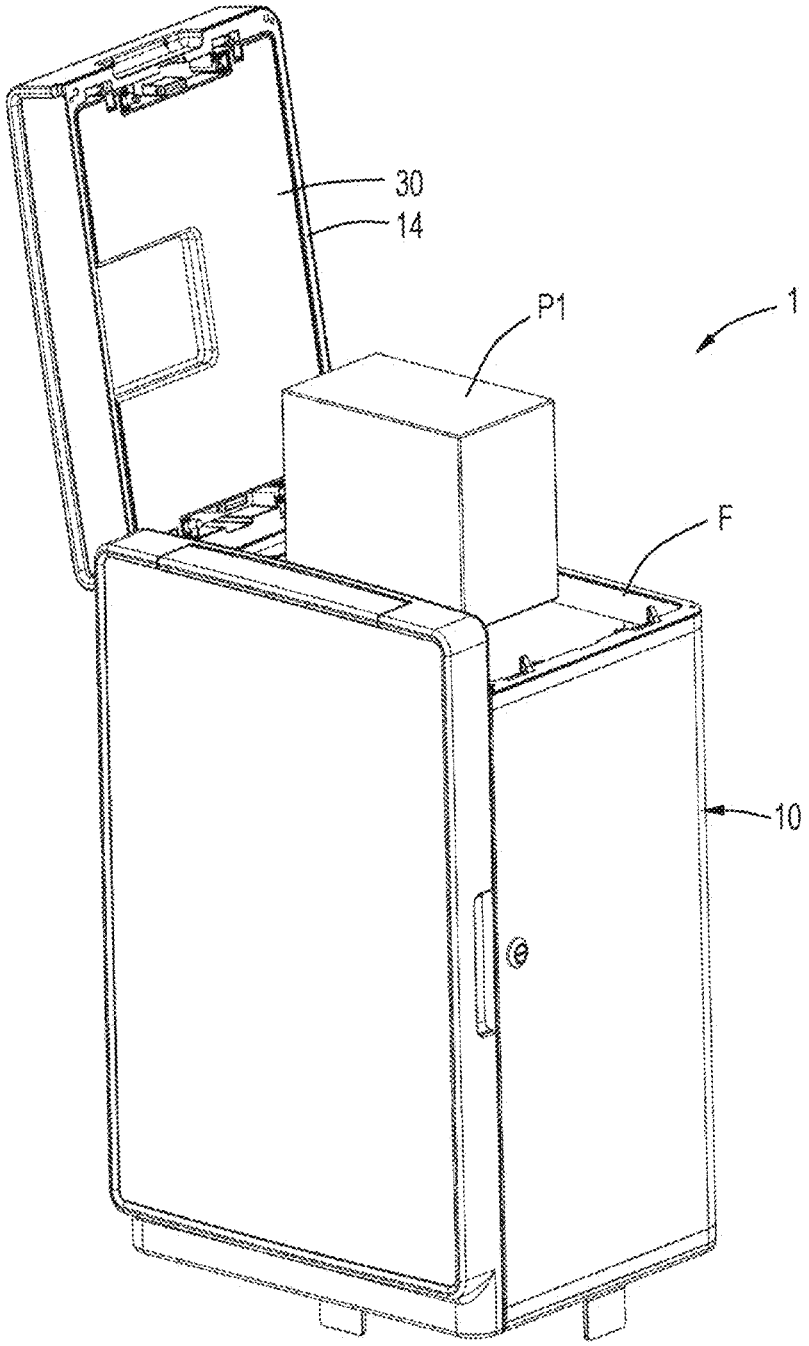
Figure 6:
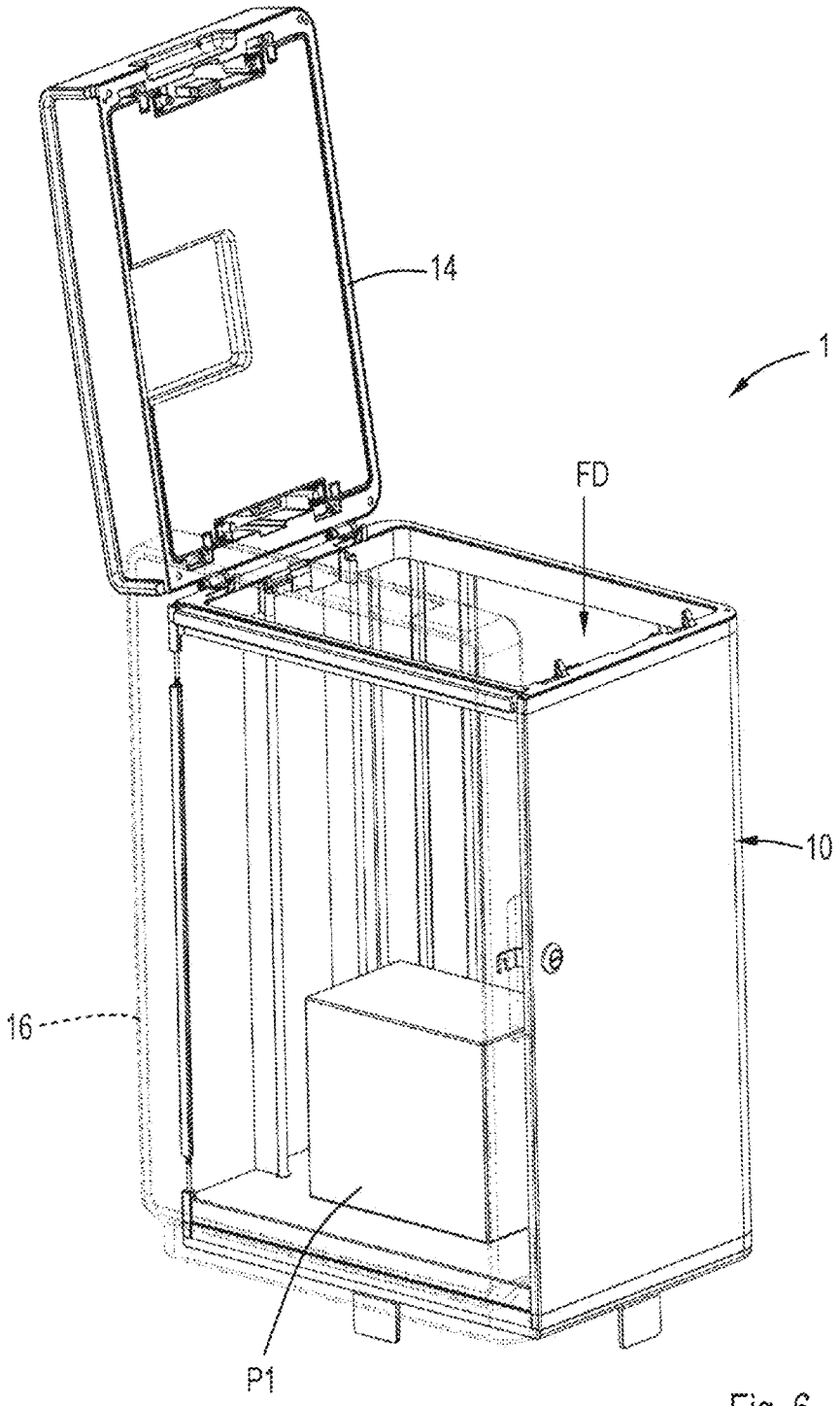
Figure 7:
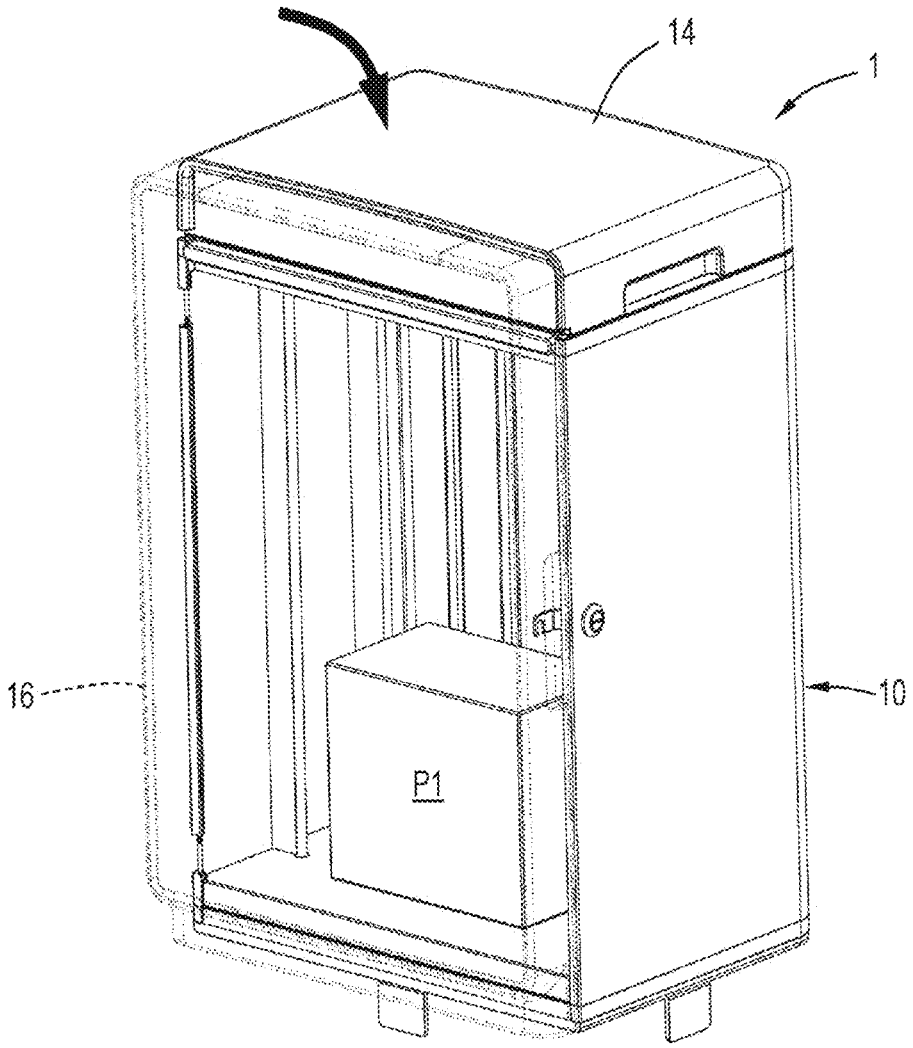
Figure 8:
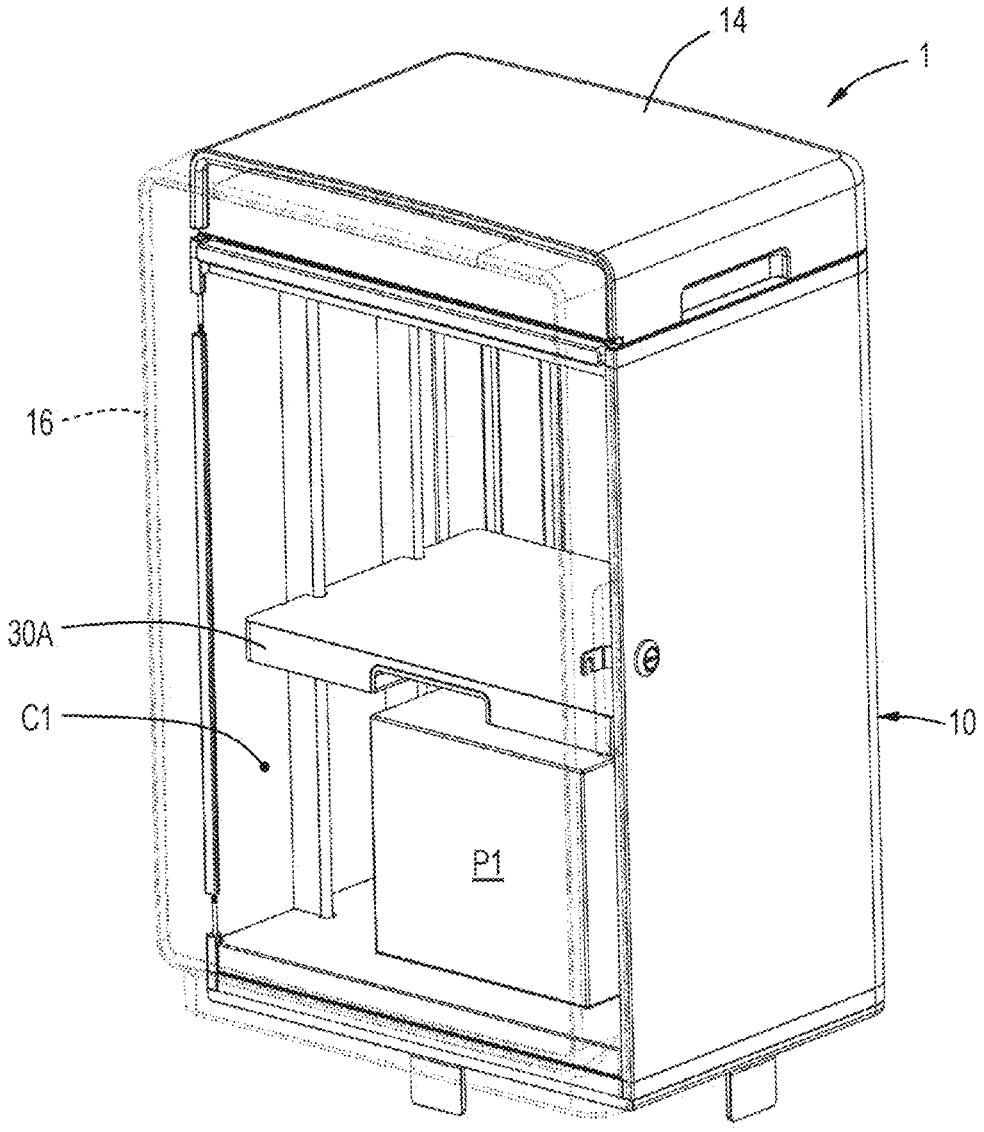
Figure 9:
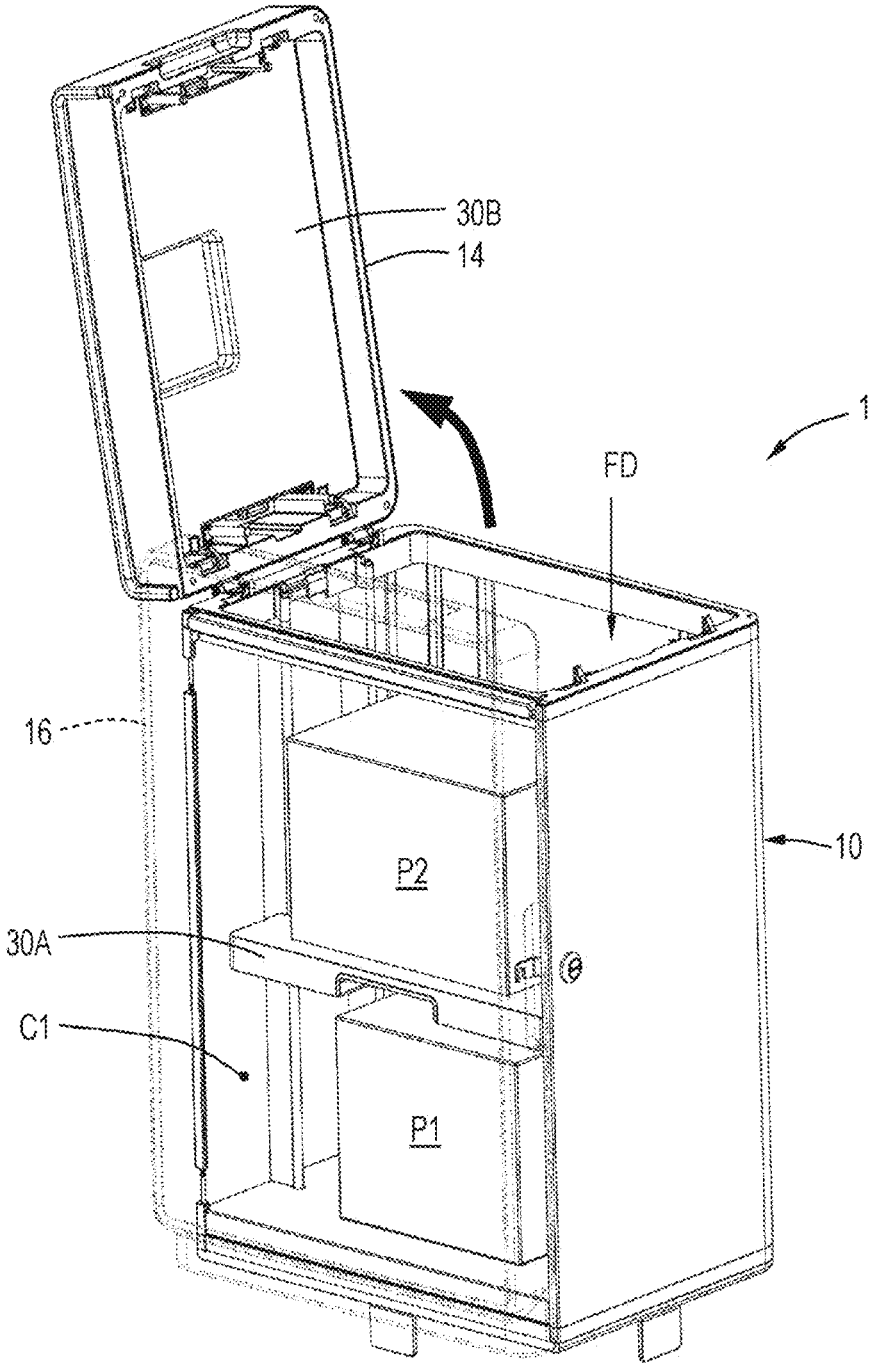
Figure 10:
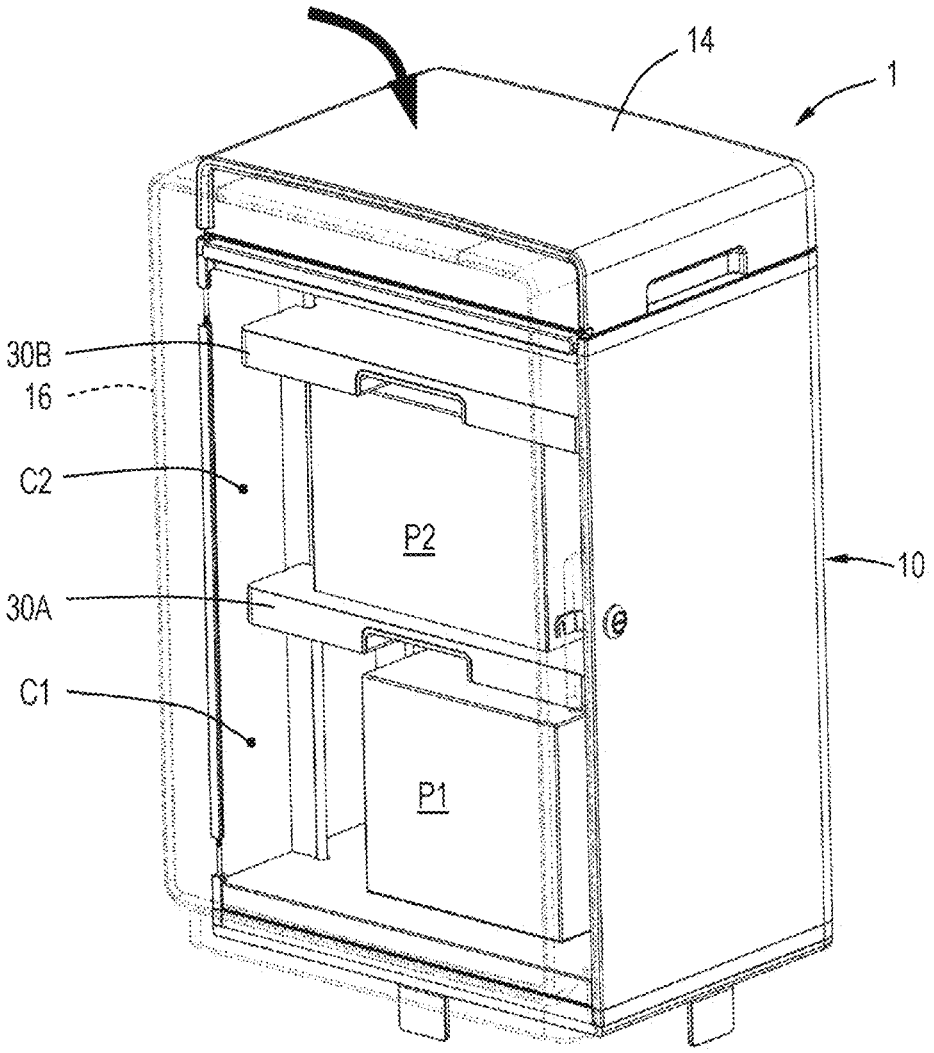
Figure 11:
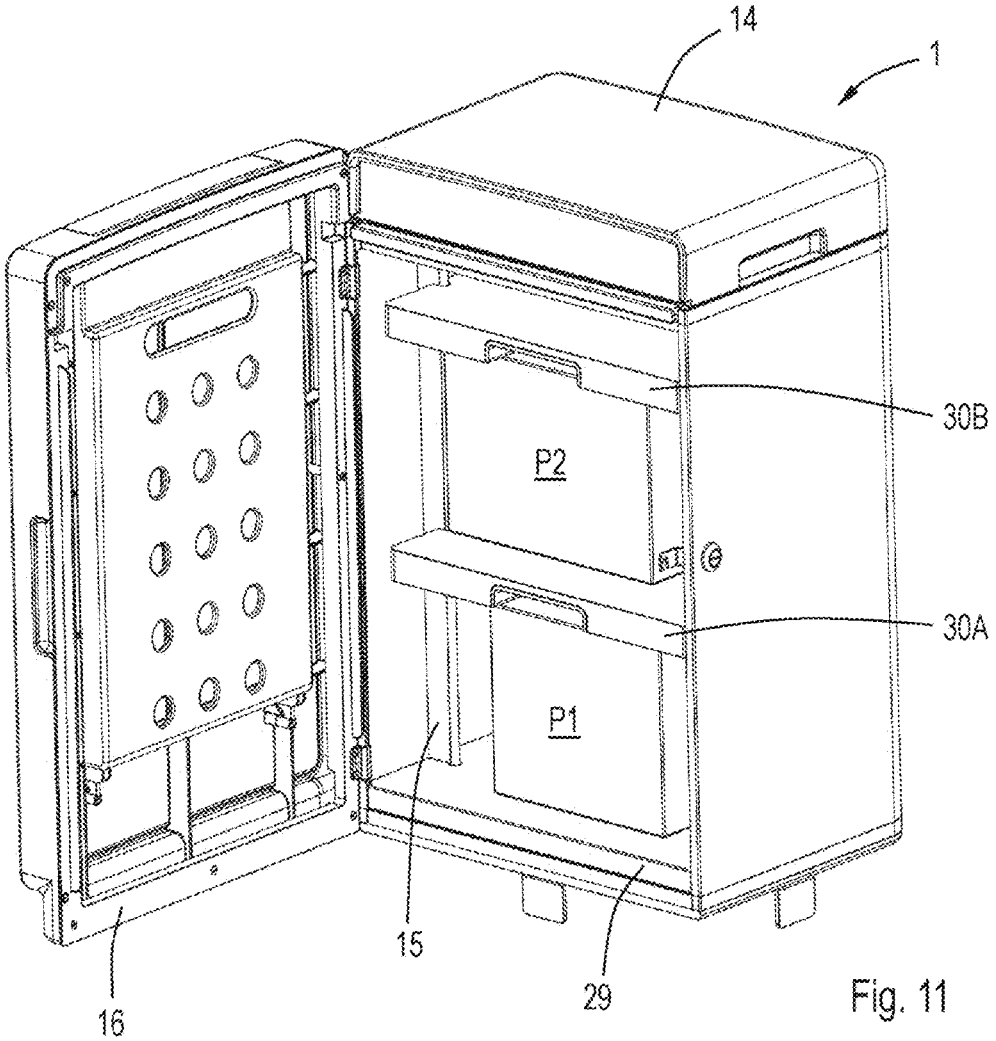

For the introduction, the lid 14 is opened to gain access to the filling end F of the shaft 10 accommodating a parcel P1 into the shaft 10 along the filling direction FD (FIGS. 5-6). After introduction of a parcel P1, the lid 14 may be closed.

The lid 14 serves as a dispenser for dividers 30 stored as a stack in the lid 14, see below. Closing the lid 14 dispenses a first divider 30A of the dividers 30 into the shaft 10 (see below). The bottom 12 may be provided with a cushion 29 or other system preventing damage to the parcel P1. The first divider 30A is movably locked to the shaft 10 and is substantially limited to translation within the shaft 10 in the filling direction FD, so that the divider 30A does not tilt. The divider 30A may travel into the shaft 10 until it rests against the parcel P1. Thus, the first divider 30A closes off part of the shaft 10 forming the thus closed off part into a first compartment C1 for storing the (first) parcel P1 and preventing access to that parcel P1 from the filling end F shaft 10, see FIG. 8. Above the divider 30A the shaft 10 provides space for a subsequent parcel.

Then, a second parcel P2 may be introduced into the shaft 10, just as before, by opening the lid 14. Then, the available space in the shaft 10 above the divider 30A for accommodating the second parcel P2 may be assessed. After introduction of the second parcel P2 into the shaft 10 (and on the first divider 30A), the lid 14 may be closed. Note that the weight of the second parcel P2 may push the first divider 30A further into the shaft 10 if needed and if possible. Upon closing, the lid 14 dispenses a second divider 30B of the dividers 30 into the shaft 10 (see below). The second divider 30B is also movably locked to the shaft 10 and is substantially limited to translation within the shaft 10 in the filling direction FD. Hence, after introduction of the second parcel P2, the second divider 30B closes off part of the shaft 10, forming the thus closed off part into a second compartment C2 between the first and second dividers 30, 30 for storing the (second) parcel P2 and preventing access to that parcel P2 from the filling end F shaft 10, see FIG. 8.

Each compartment C1, C2 has a volume associated with the volume and/or size of the respective parcel P1, P2.

The sequence may be repeated for introducing further parcels Px separated by respective dividers 30*x* in respective compartments Cx (x=1, 2, . . . ) until the shaft 10 is filled and/or the dispenser runs out of dividers 30. All dividers may be the same or one or more of them may differ. E.g., the last divider 30 in the dispenser to be dispensed may differ by being immovably lockable to (the filling end F of) the shaft 10 (not shown).

Figure 12:
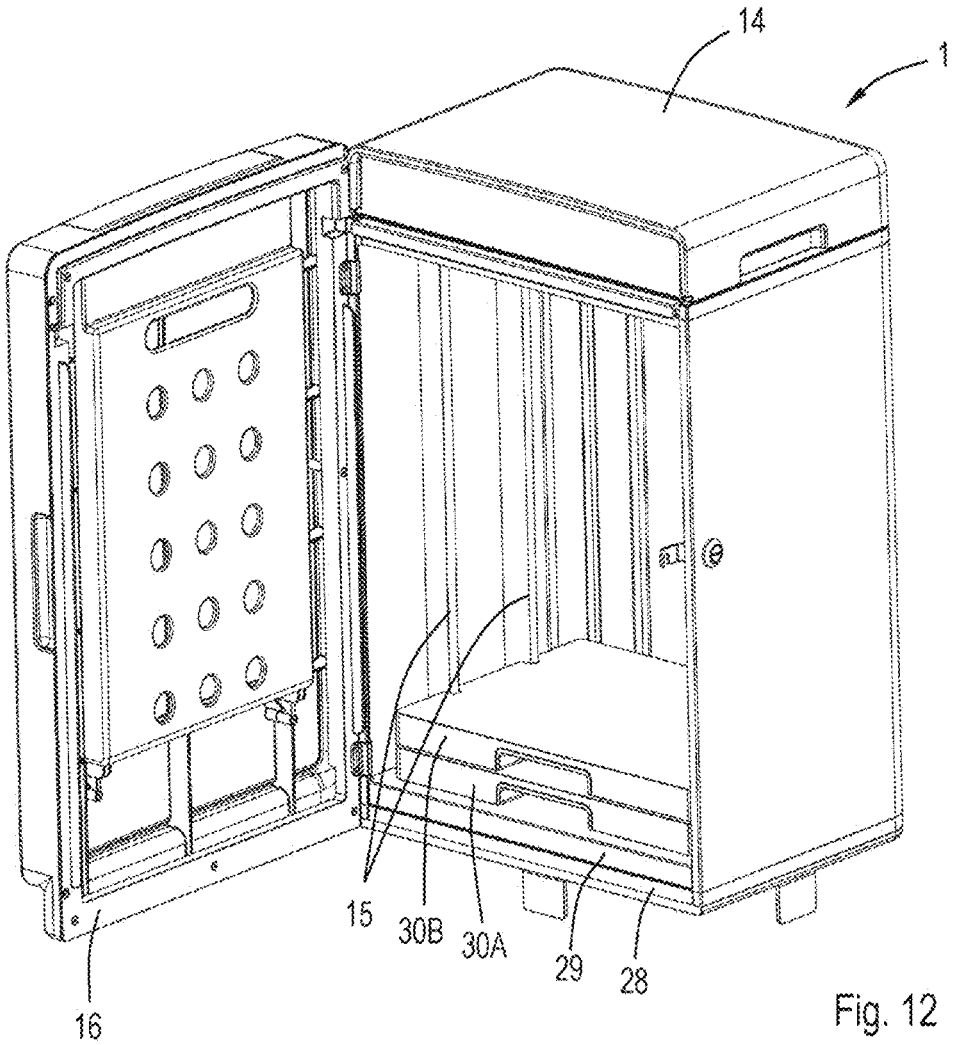

For retrieving one or more of the parcels P1, P2 and emptying the respective compartments C1, C2, the door 16 may be opened (FIGS. 11, 12, see also FIG. 4) which provides access to the compartments C1, C2, and the dividers 30 from another direction than the filling direction FD.

One or more of the dividers 30 may then be returned into the dispenser for restoring the apparatus to a default state for receiving further parcels. Realisation of that in the present embodiment will be explained later herein. First, construction and operation for filling and sequentially dispensing dividers 30 associated with the opening and/or the closing of the lid 14 will be discussed in more detail with reference to FIGS. 13-20.

Figure 13:
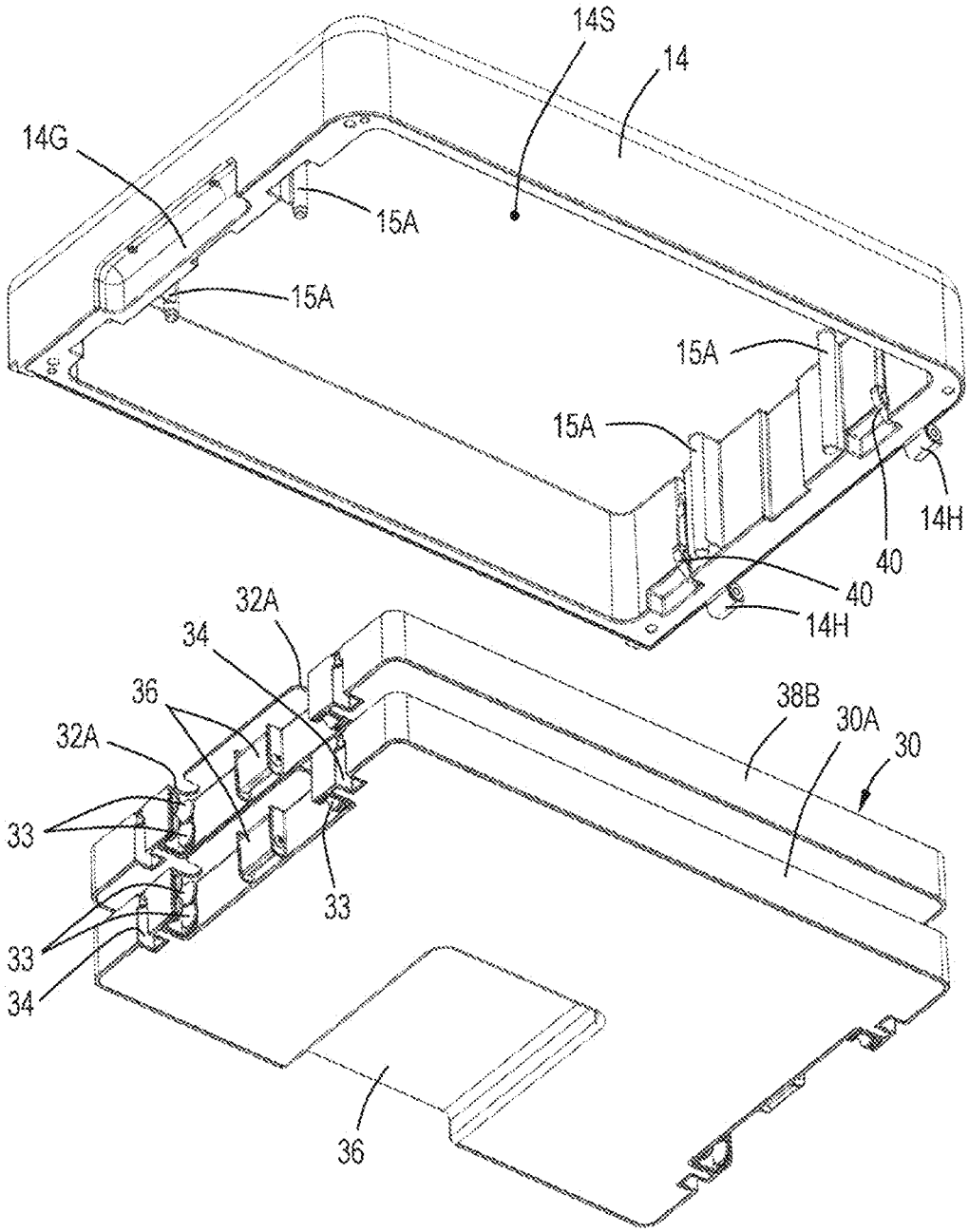
FIG. 13 shows a stack of two dividers and a lid of the parcel box.
Figure 14:
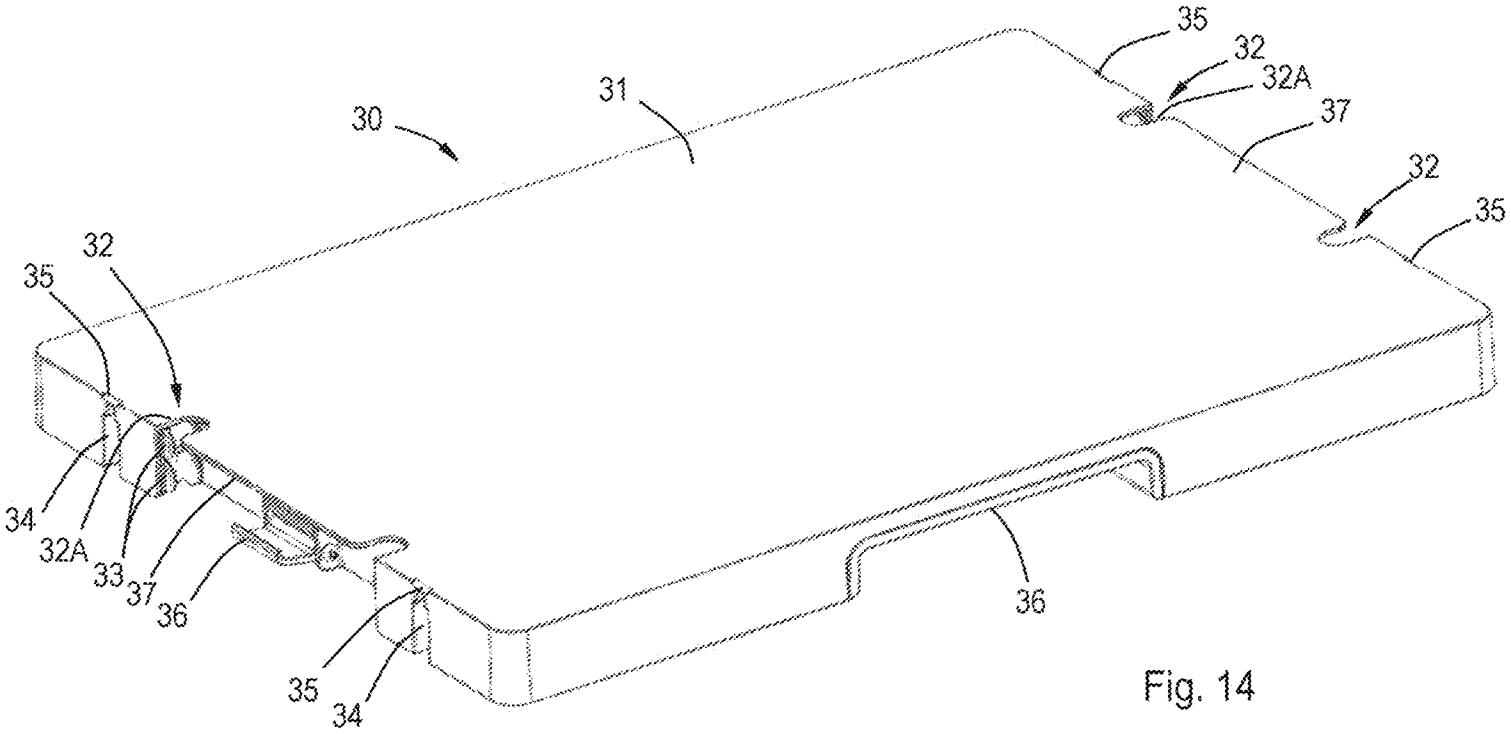
FIG. 14 shows an embodiment of a divider.
Figure 15:
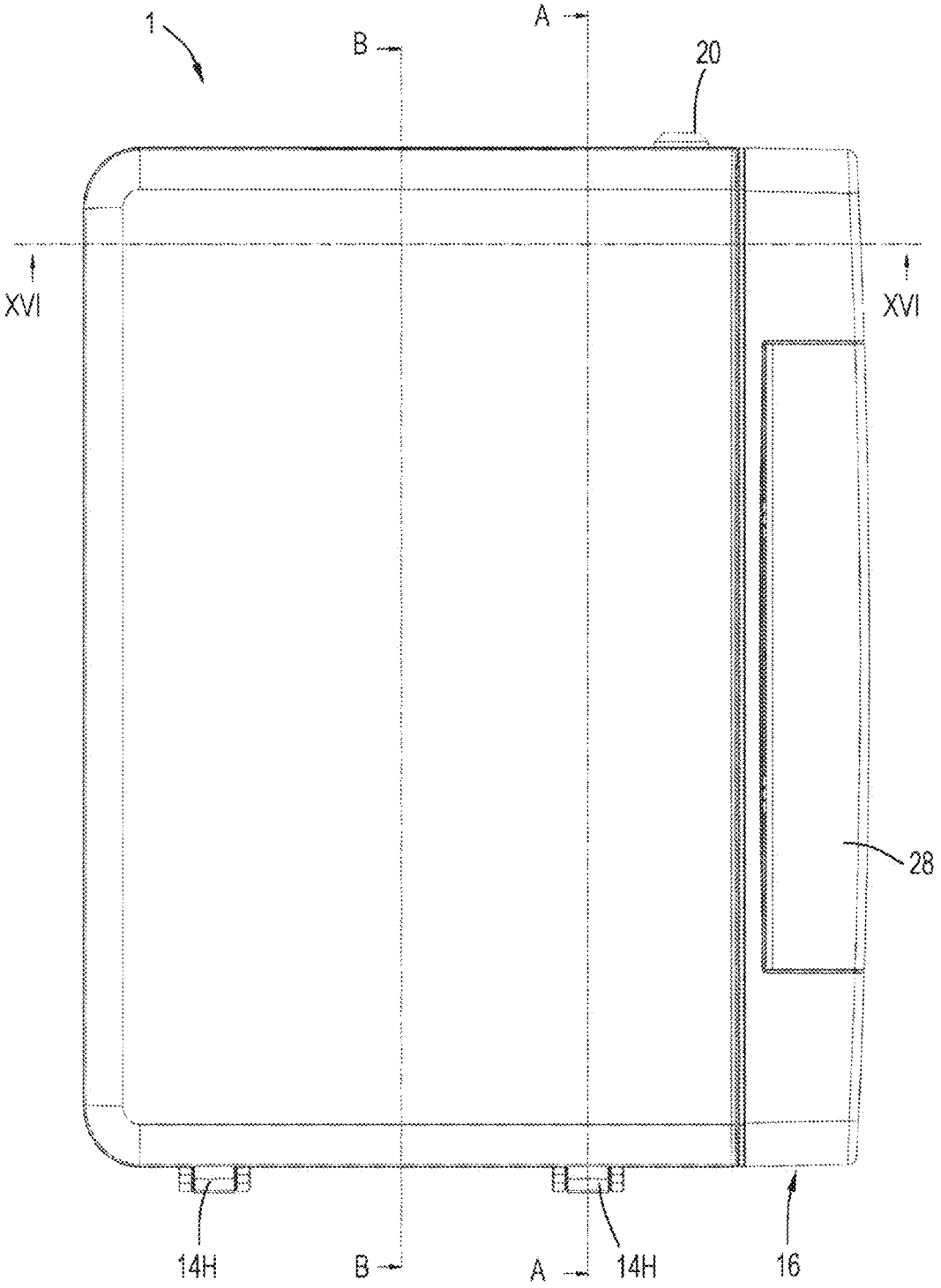
FIG. 15 is a top view of the parcel box with section planes A-B and XVI indicated.
Figure 16:
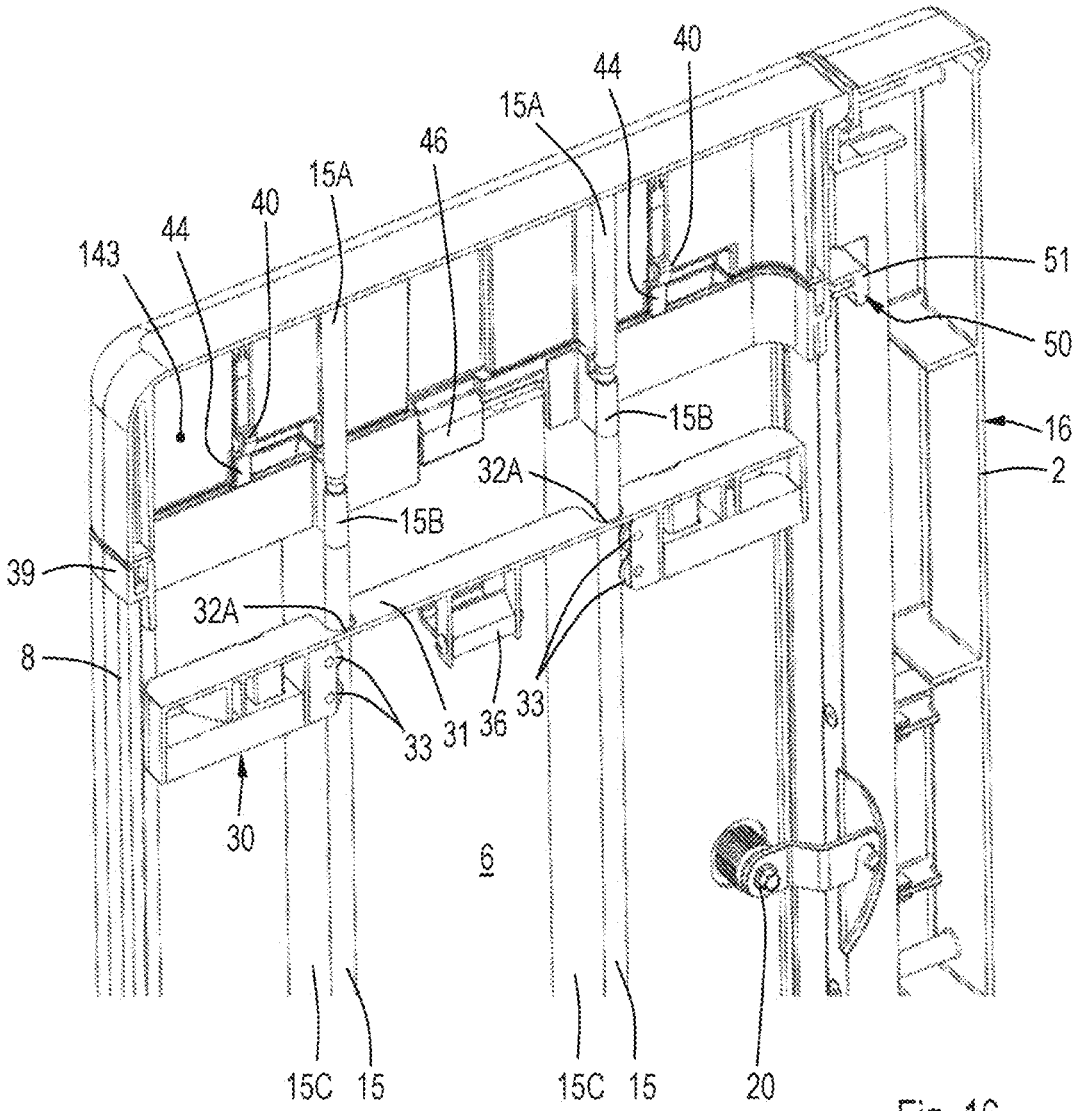
FIG. 16 is a partial cut-away view of the parcel box along section plane XVI.
Figure 17:
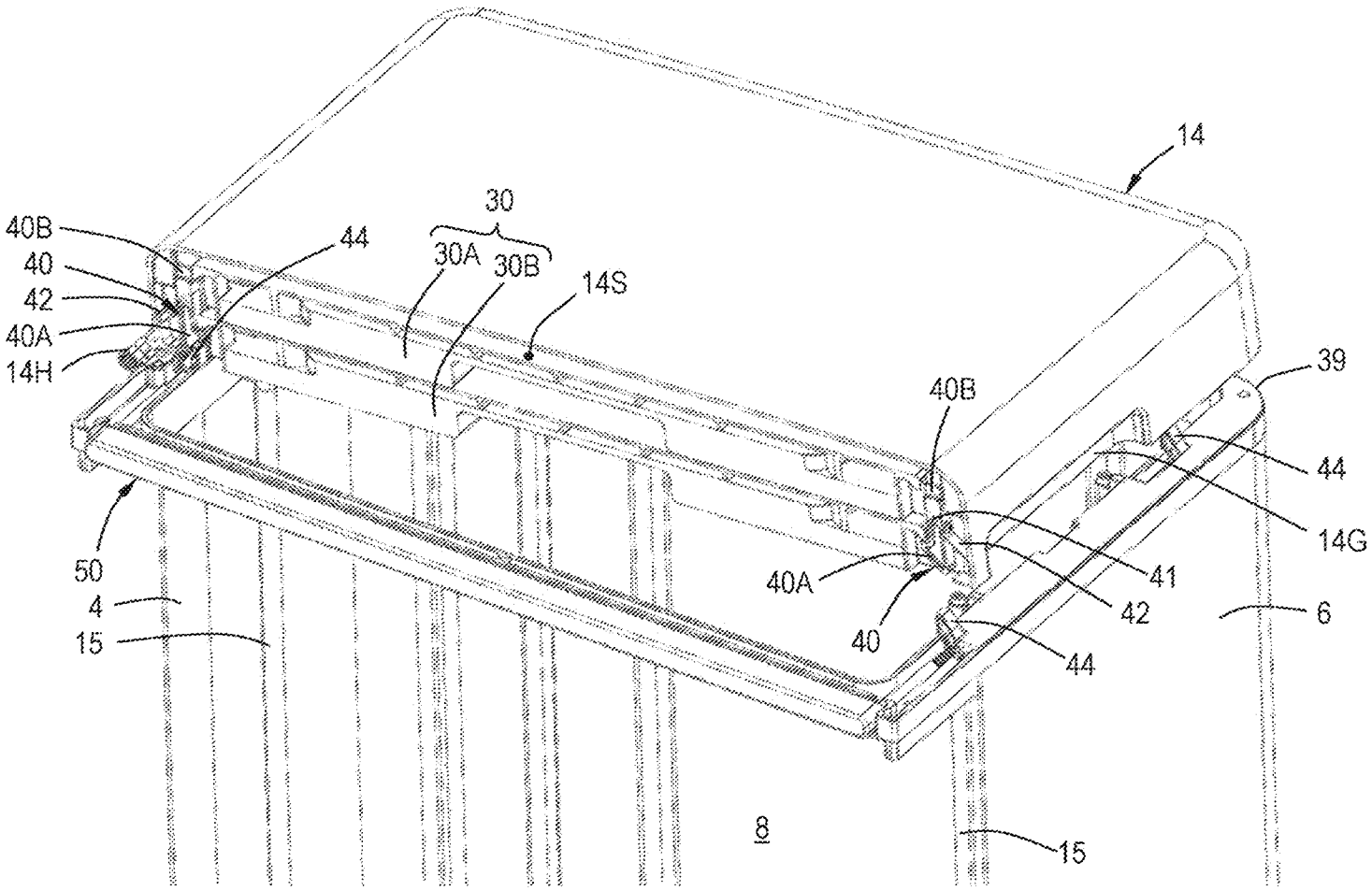
FIGS. 17-18 are partial cut-away views of the parcel box along section plane A, in different use stadia.
Figure 18:
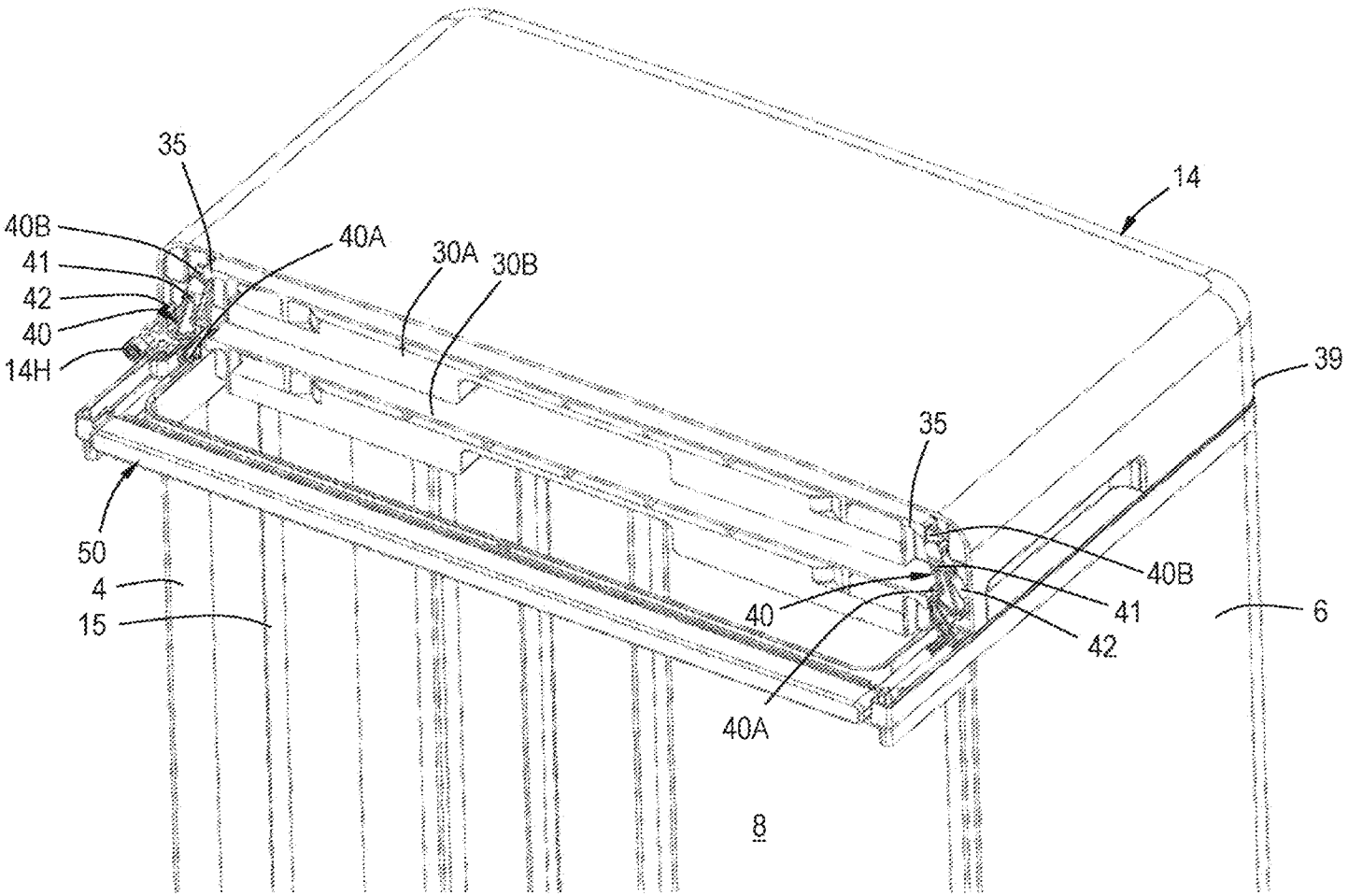
Figure 19:
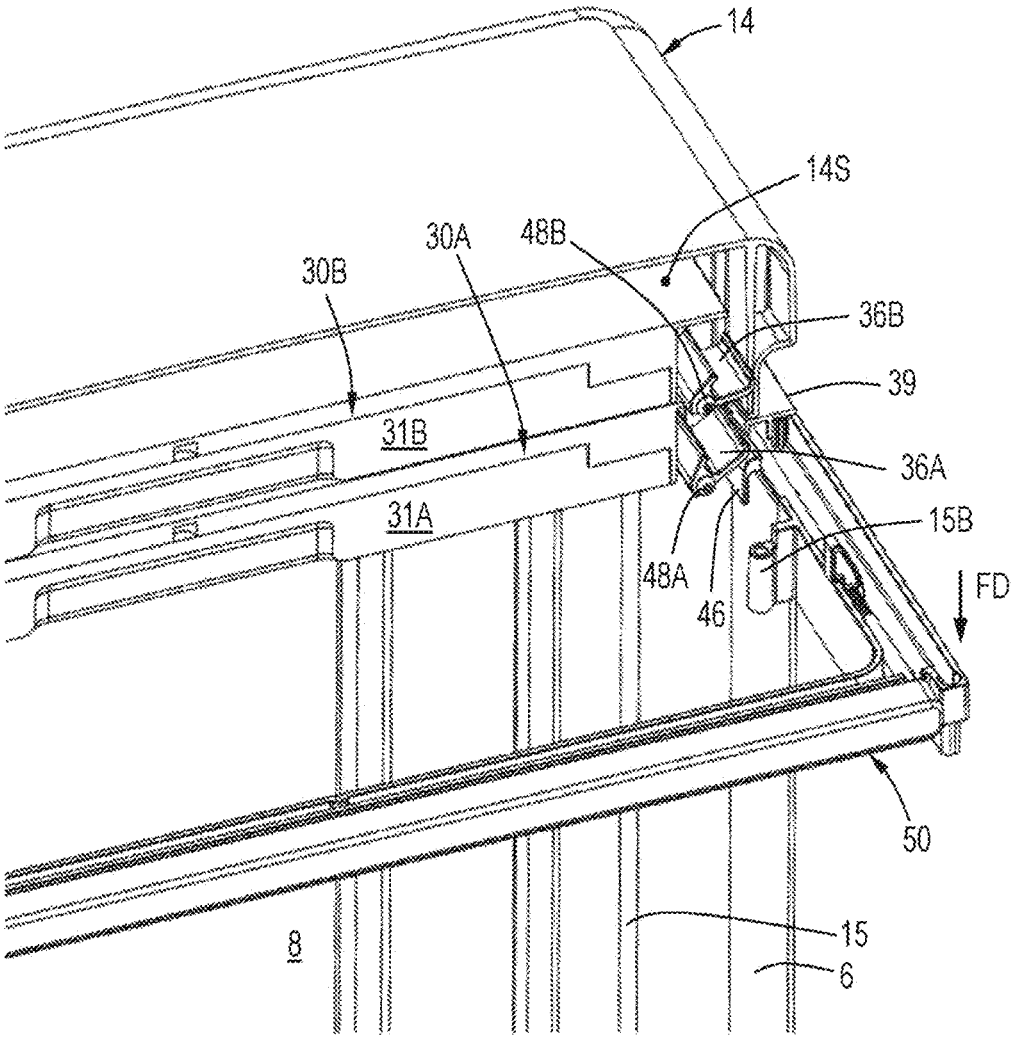
FIGS. 19-20 are partial cut-away views of the parcel box along section plane B, in different use stadia.
Figure 20:
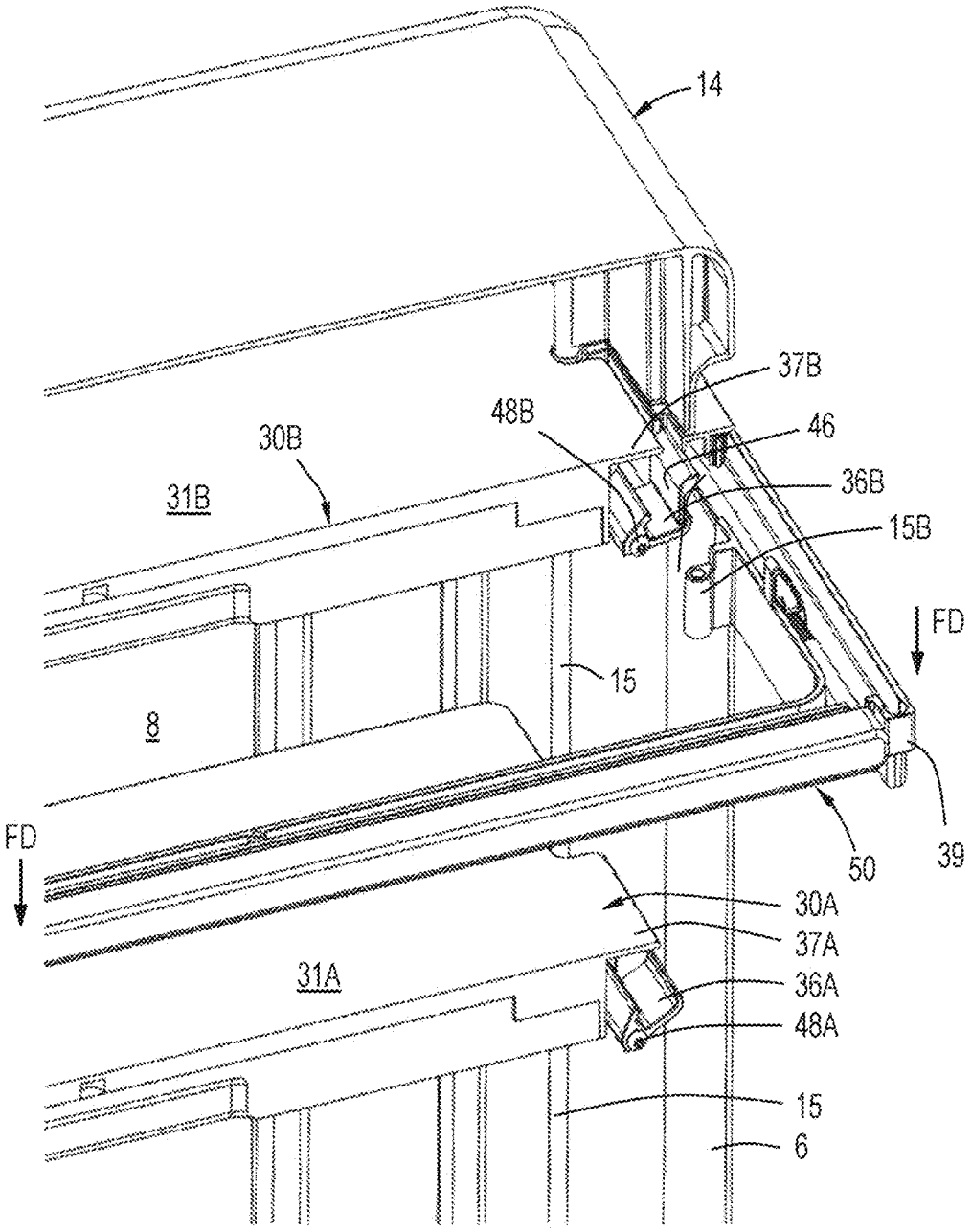

FIG. 13 shows in partly exploded view the lid 14; serving as a dispenser for dispensing dividers 30. The lid 14 comprises a space 14S for holding a number of dividers 30, here first and second dividers 30A, 30B, which here are identical as an option. FIG. 14 shows in perspective view an embodiment of a divider 30. FIG. 15 is a top view of the embodiment with section planes A, B and XVI indicated, which are used in the following figures. FIG. 16 is a partial cut-away view of the apparatus 1 along section plane XVI, showing only a single divider 30. FIGS. 17-18 are partial cut-away views of the apparatus 1 along section plane A. FIGS. 19-20 are partial cut-away views of the apparatus 1 along section plane B, in different configurations, each of these Figures showing two dividers 30. In FIGS. 17-20 a rim 39 and bracket 50 are shown not cut away.

Referring primarily to FIGS. 13-16, The divider 30 comprises a divider panel 31 comprising connectors 32 for coupling to associated rails 15A in the lid 14 and the rails 15 in the shaft 10 which comprise rail portions 15B of the rim 39 of the shaft 10 and further rail portions 15C. Note that, when the lid 14 is closed as shown in FIG. 16, the rail portions 15A, 15B, 15C provide a substantially continuous rail 15. The connectors 32 comprise openings 32A for accommodating (the respective portions of) the rails 15. The connector is provided with wheels 33 for cooperating with the rails 15, 15A for moveably coupling the divider 30 to (the rails 15 of) the shaft 10. Here, the wheels 33 and rails 15 have, as a preferred option, at least partly complementary shapes for at least partly locking the divider 30 to the rails 15A, 15. Due to the number and arrangement of wheels 33 on opposite sides of the divider 30 and the rails 15A, 15, respectively, tilting of the divider 30 relative to the rails 15, 15A, and therewith tilting with respect to the shaft 10 and the lid 14, respectively, is prevented, see FIG. 16.

In another embodiment, not shown, at least part of the connectors 32 may be formed as openings having a relatively narrow entrance, as a C-shape, so that the divider 30 can be locked to rails having an associated shape by the connectors; the associated shape may e.g. comprise a rod and/or a rail having a relatively broad portion connected with a narrow neck to a support along its length. The connectors may comprise an additional locking portion and/or a guide portion increasing prevention against tilting of the divider when coupled with an associated rail.

The divider 30 comprises further optionally recesses 34 and ridges 35 as coupling structures for operably coupling with at least part of the dispenser, and it comprises latches 36 rotary attached to the panel 31 (compare FIGS. 13-14) for locking the divider 30 to the shaft 10, see below. A flange 37 or other structure (not shown) overlaps part of each latch 36. As a further option the divider 30 is provided with a grip 36.

In FIGS. 13 and 17-18 are visible: hinges 14H and grip 14G for opening the lid 14 with respect to the shaft 10, and, as an option, a rim 39 to be arranged at the filling end F of the shaft 10. As shown, the rim 39 may be a separate member or it may be, at least partly, integrated into the shaft 10 at the filling end F thereof.

As shown in, and discussed for, FIG. 13, the lid 14 proper is hollow, providing a space 14S for holding plural dividers 30 arranged in a stack. The lid 14 comprises latches 40 forming first coupling members for engaging and holding the dividers 30. As an option, the latches 40 are formed as levers pivotally about hinges 41, and an optional spring 42 biases the latch 40 about the hinge 41. Also or alternatively the latches 40 may comprise a resilient portion, e.g. at least part of the latch 40 being resilient.

The latches 40 and the recesses 34 and ridges 35 of the dividers 30 form portions mated to each other for engagement and supporting each divider 30 in the dispenser and sequentially freeing and dispensing successive dividers 30.

At the filling end, ledges 44 are provided as first decoupling members for decoupling the first coupling members (i.e. the latches 40 in this embodiment).

FIGS. 17-18, 19-20, show stages of closing of the lid 14 onto (the filling end F of) the shaft 10 (FIGS. 17-18) and dispensing a divider 30 into the shaft 10 (FIGS. 19-20).

In FIG. 17, the lid 14 is opened relative to the shaft 10. This configuration corresponds to FIGS. 4-6 for introducing a parcel P into the shaft 10. The latches 40 are arranged such that a first end 40A of the latch 40 engages and supports the first divider 30A by gripping around and engaging the ridges 35 of the divider 30A. The recesses 34 accommodate part of the latches 40. Thus, the latches 40, recesses 34 and ridges 35 form cooperating coupling members for, thus arranged, retaining the dividers 30 in the lid 14.

In FIG. 18 the lid 14 is closed onto (the rim 39 of) the shaft 10. This configuration may correspond to FIG. 7 after introducing a parcel P into the shaft 10.

The ledges 44 of the rim 39 each are aligned to a latch 40 of the lid 14 and are configured for, upon closing of the lid 14, engaging an associated one of the latches 40 of the lid 14 and moving at least part of the respective latch 40 to decouple it 40 from at least one divider 30. In particular, by the engagement of (the first end 40A of) the latches 40 and the ledges 44, the latches 40 are pivoted about their hinges 41 by which the first ends 40A of the latches 40 are decoupled from the first divider 30A in the lid 14. Therewith, this first divider 30A is freed at least partly from the lid 14, and thus released, the first divider 30A may couple with, and be locked to, the shaft 10 see below. At the same time, by the pivoting of each latch 40, the second end 40B of the latch 40 is caused to engage the second divider 30B and retain the divider 30B (and any further dividers 30 in the stack in the lid 14—but the shown embodiment does not contain such further dividers 30). Thus, only one divider 30 is freed.

Note that, on opening of the lid 14, due to the resilient spring 42, the latches 40 may return to the position shown in FIG. 17 to engage (or possibly: re-engage) the lowermost one of the dividers 30 so that it/they remain in the lid 14 (and any further dividers 30 in the stack in the lid 14, if present), cf. FIG. 17. Thus, closing and opening the lid 14 once may free and dispense one divider 30. Thereafter, any remaining divider(s) 30 in the stack may be dispensed sequentially in its/their turn.

On dispensing a divider 30, the divider 30 drops along the rails 15 into the shaft 10; the connectors 32 of the divider 30 (i.e. the opening 32A and the wheels 33) are connected to rail portions 15B and rails 15C of the shaft rail portions 15A in the shaft 10. Thus, the divider 30 is movably coupled to the shaft 10 wherein the movement is limited to translation along the rails 15.

In some embodiments, not shown, a divider may be held in a predetermined position relative to the shaft. E.g., associated with the divider 30 being freed and dispensed from the dispenser, the divider 30 may be positioned and held in the shaft 10 in a predetermined position at the filling end. The predetermined position may be defined by paired magnetic and/or magnetisable members in the divider 30 and (the rim 39 of) the shaft 10, respectively. Also or alternatively, a predetermined position may be determined by one or more of (preferably at least partly resilient) interlocking features like protrusions and recesses, latches etc. From such predetermined position, the divider 30 may be released for movement into the shaft 10.

FIG. 19-20 show locking a dispensed divider 30 to the shaft 10, partly cut away along section plane B. In the shown embodiment, in each divider 30A, 30B, the respective latch 36A, 36B is connected to the respective divider panel 31A, 31B via a pivoting hinge 48A, 48B. Associated with the lid 14 being closed, the divider 30A is freed and dispensed from the dispenser and the divider 30A may move down into the shaft 10 in the filling direction FD along the rail 15. In the filling portion of the shaft 10, the shaft 10 comprises engagement structures such as a locking ledge 46, in particular on opposite sides (FIG. 20 showing only one side). The locking ledge 46 may in particular be arranged in the rim 39. Associated with the movement of the divider 30A in the filling direction FD, the latches 36A latch behind the ledges 46. Thus, the latch 36A and ledge 46 cooperate and lock the divider 30A to the shaft 10 so that the divider 30A may move further into the shaft 10 along the rails 15 in the filling direction FD but also so that the divider 30 cannot be removed from the shaft 10 from above, since the latch 36 engages the ledge 46 (FIG. 20—upper divider 30B). Note that divider 30 is, optionally, formed such that access to the latches 36 from the filling end is hindered or prevented at least when locked to the filling end (e.g. FIG. 20) and preferably also when the divider 30 is moved further into the shaft 10. Here, the flange 37 of each divider 30 blocks access from to the respective latch 36 along the filling direction.

FIG. 20 shows a configuration wherein both the first and the second divider 30A, 30B are dispensed from the lid 14 and are locked to the shaft 10 via the latches 36B being (arranged to be) blocked by the ledges 46 when moved against the filling direction.

In any divider 30, latches 36 may be provided with a resilient portion, e.g. by provision of a spring member (not shown) and/or at least part of the latch 36 being resilient, for urging the latch 36 into a locking position, e.g. for urging the latch 36 outward with respect to the divider panel 31 (FIGS. 14, 20). Note that in some embodiments the divider 30 may be supported on the latches on the ledge or some other feature for defining a predetermined position with respect to the shaft 10, and that upon some force on the divider, e.g. due to the weight of a parcel, the divider may be pushed down into the shaft operating the latches to latch onto the ledges. Also or alternatively, at least part of the latch 36 may be formed for urging the latch 36 into a locking position by gravity and/or by other means, e.g. a magnet. Due to the locking, the divider 30 cannot be removed from the shaft 10.

Figure 20A:
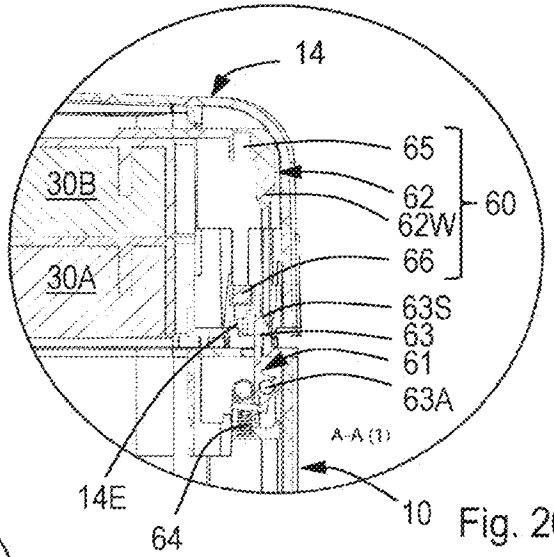
Figure 20B:
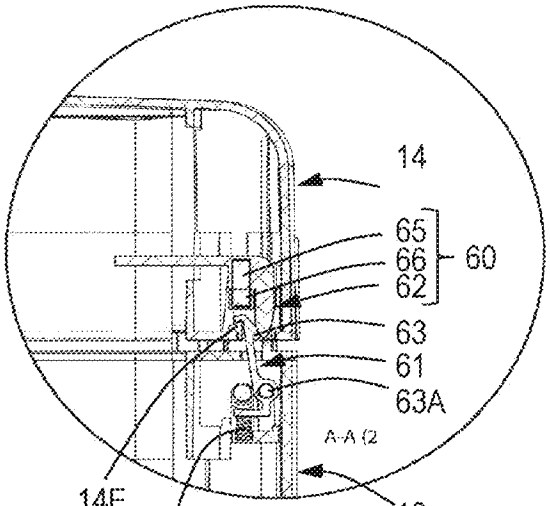
Figure 20C:
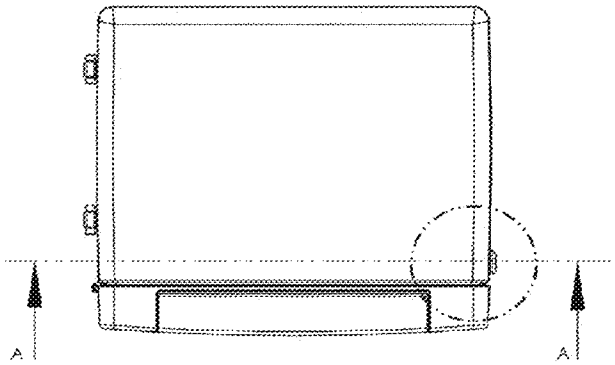
Figure 21:
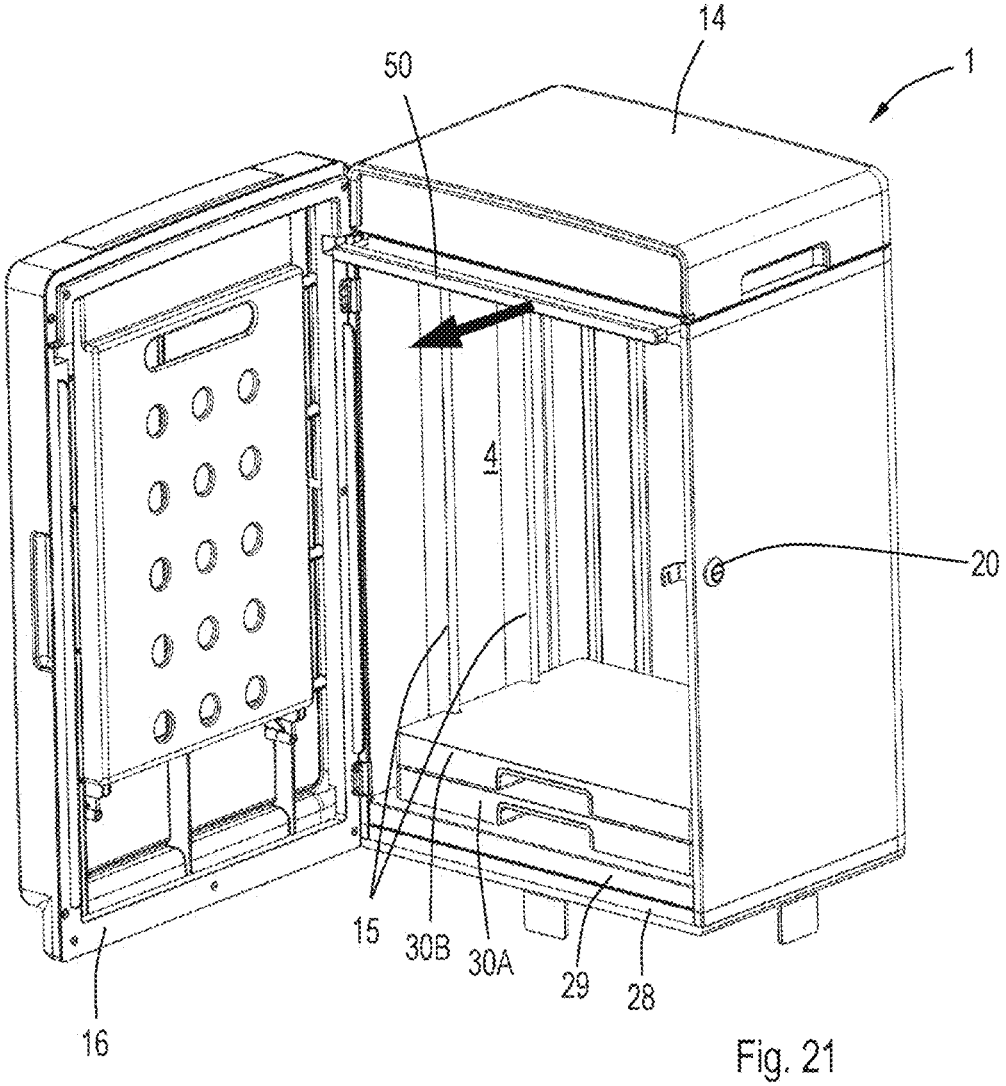
FIGS. 21-24 indicate use and operation steps of the parcel box for restoring use after receiving parcels.
Figure 22:
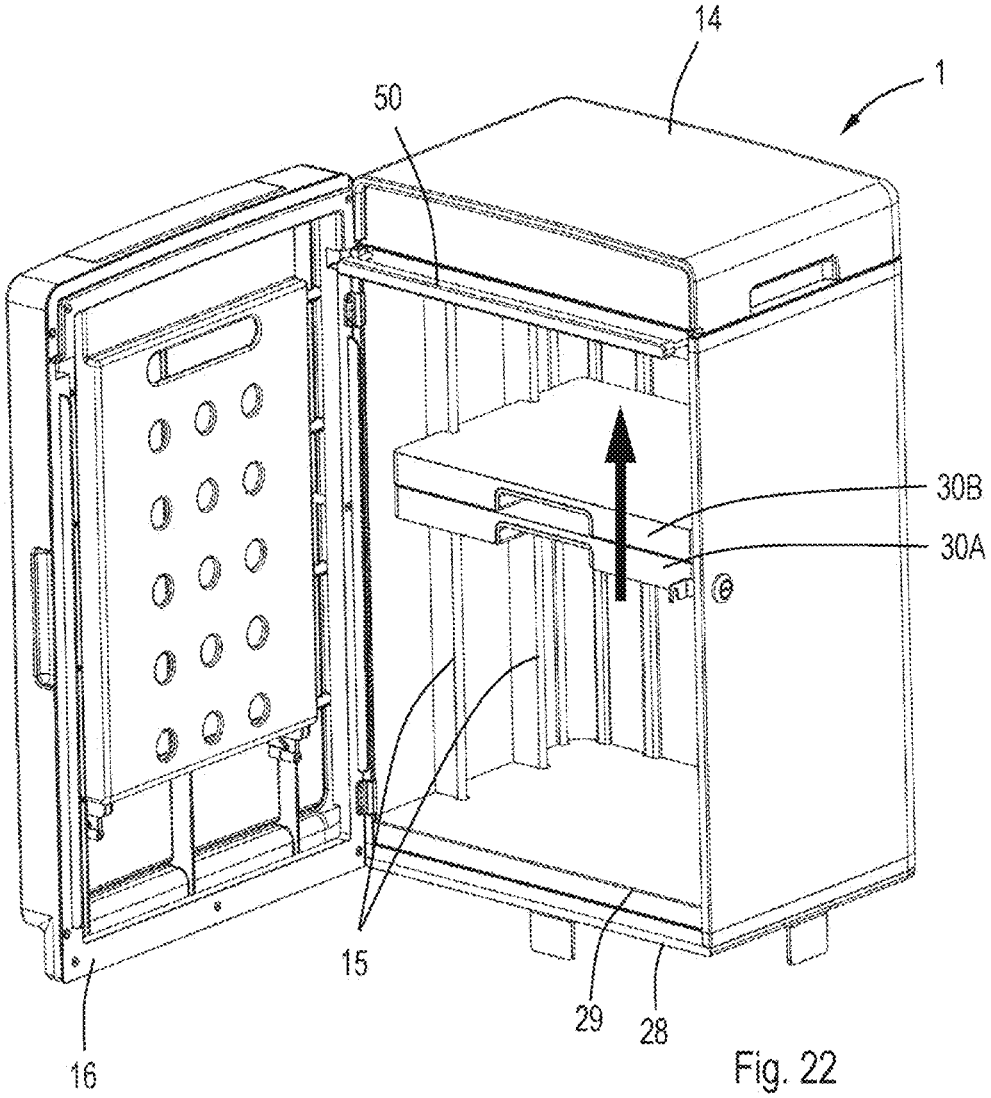
Figure 23:
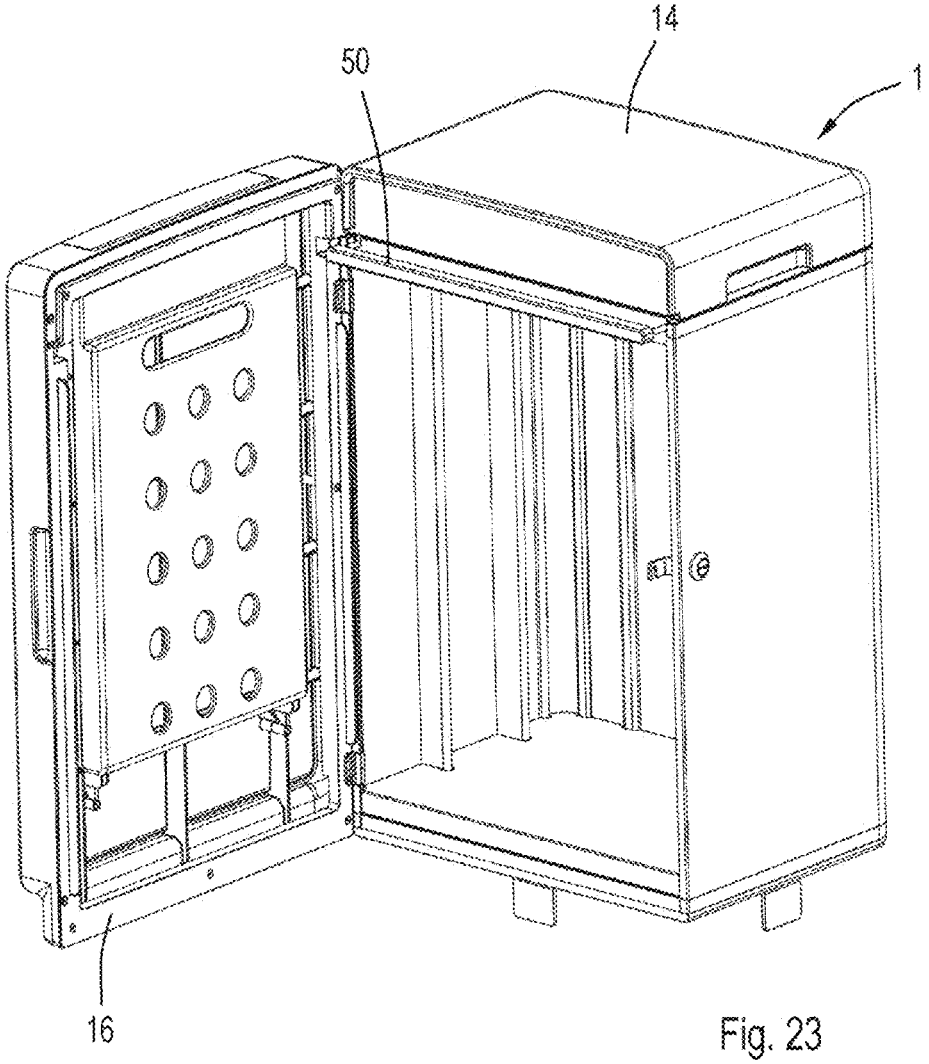

FIGS. 20A-20C show (operation of) an optional lid locking system for locking the lid 14 to the shaft 10 after the last divider 30 is dispensed and moved into the shaft 10, e.g. after receiving a package on the last divider 30B. FIGS. 20A-20B are details of the box 1 in cross section A-A in FIG. 20C.

In a first configuration (FIG. 20A) of the lid locking system the lid 14 is free to open for receiving packages as discussed above, and in a second configuration (FIG. 20B) the lid 14 is locked to the shaft 10 in a closed position preventing opening of the lid 14. Thus, a package may be filled into the shaft 10 on the last divider 30B and be made inaccessible. The lid locking system comprises a first locking device 60 and a second locking device 61, associated with the dispenser and/or the lid 14, and with the shaft 10, respectively. E.g. the first locking device 60 engages the second locking device 61 to lock the lid 14 to the shaft 10. The first and/or second locking devices 60, 61 may be provided with one or more resilient and/or magnetic portions for urging the lid locking system into the first and/or second configuration.

In the shown embodiment, the first locking device 60 is movably arranged in and/or against the dispenser and cooperates with the last divider 30B to operate the second locking device 61. In the shown embodiment the first locking device 60 comprises a follower 62 engaging the last divider 30B. The second locking device 61 comprises a latch 63 movably arranged in (the rim 39 of) the shaft 10, e.g. resiliently deformable and/or rotary about an axis 63A as shown. At least part of the first locking device moves from a first position (FIG. 20A) and/or orientation to a second position (FIG. 20B) and/or orientation by movement of the divider 30B in the dispenser dispensing the dispensers 30A, 30B; in the shown embodiment part of the follower rests on (the last (i.e. upper) of) the dividers 30. A portion of the follower 62 is configured to engage, in the second position (FIG. 20B), a portion of the latch 63 to urge the latch 63 into locking arrangement with the lid 14. In particular, the follower 62 and the latch have cooperating portions, here a wedge portion 62W and a slanted surface 63S, respectively, to urge (a rotation of) at least part of the latch 63 into operable engagement with part of the lid 14. Here, the latch 63 hooks onto an engagement portion 14E of the lid 14, wedged-shaped to secure engagement of the latch 63 and the lid 14.

Also or alternatively, in another embodiment (not shown), a portion of the follower 64 may be configured to latch itself, in the second position (FIG. 20B), onto a portion of (the rim 39 of) the shaft 10.

In the shown embodiment, the second locking device 61 is provided with a spring 64 or other resilient device (not shown) urging the latch 63 into an unlocking position and/or orientation in the first configuration (FIG. 20A), so that the lid 14 is free to open. The first locking device 60 comprises optional magnets 65, 66 in the follower 62 and the lid 14, cooperating to hold the follower 62 in a predetermined position for operably urging the latch 63 against the spring force of the spring 64 in a locked position in the second configuration (FIG. 20B). The latch 63 may comprise a barb (not shown).

For returning one or more of the dividers 30 into the dispenser after removing any parcels from the apparatus (cf. FIG. 12), thus restoring the apparatus to a default state for receiving further parcels, the dividers 30 must be unlocked and decoupled from the shaft 10. For that the box 1 may be opened using the door 16. After removal of any parcels Px and/or other contents of one or more of the compartments Cx, the respective dividers 30 may be slid back up along the rails 15 opposite to the filling direction FD. To unlock the dividers 30 from the shaft 10, the locking of the latches 36 must be undone; this can be done from behind each divider 30 as seen in the filling direction FD (i.e. from below in the Figs.), e.g. by tilting each latch 36 and passing it past the ledge 46 or other latching structure (cf. FIG. 20=>19).

Figure 25:
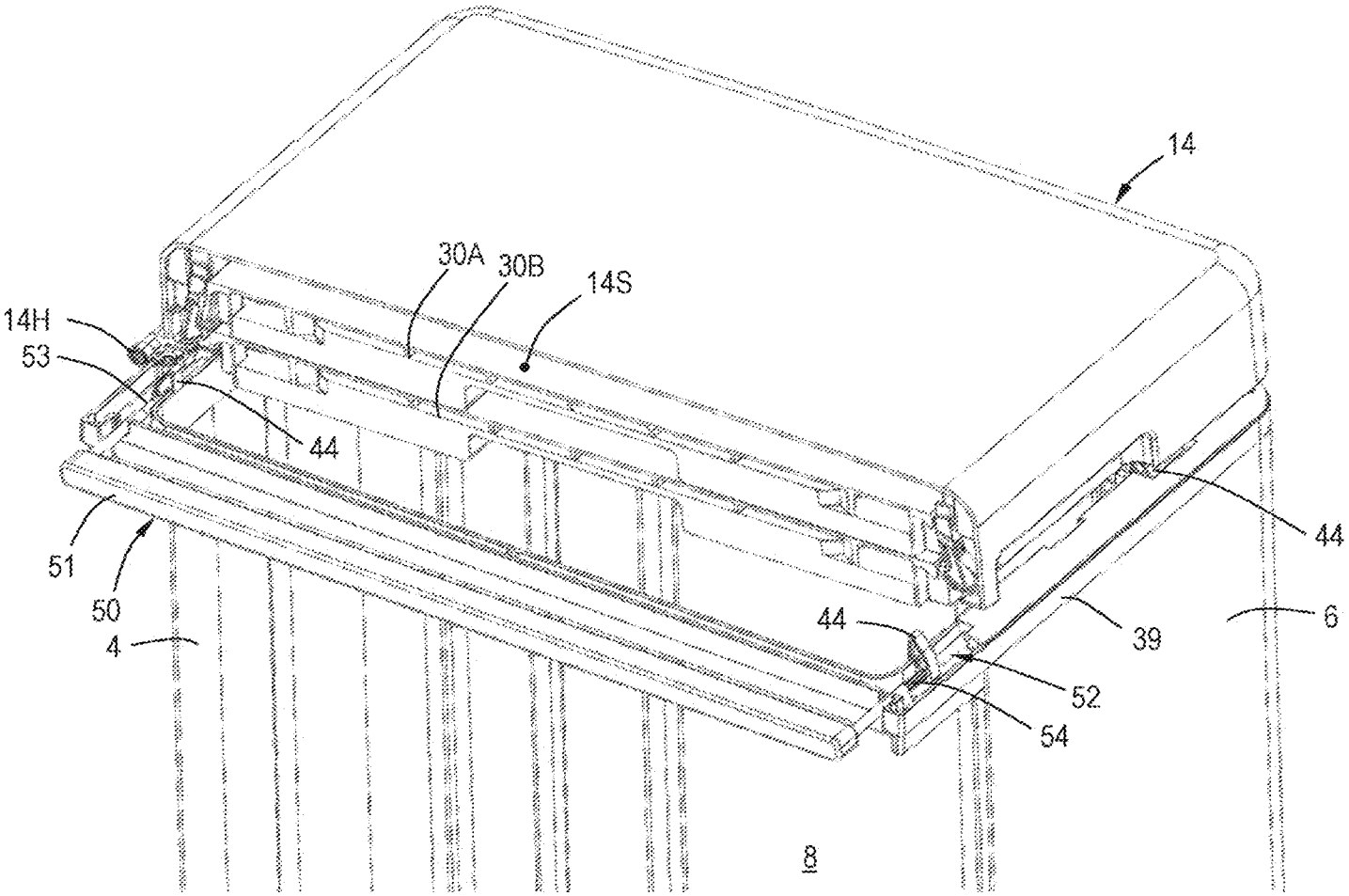
FIG. 25 is a partial cut-away views of the parcel box along section plane A in another use stadium.
Figure 26:
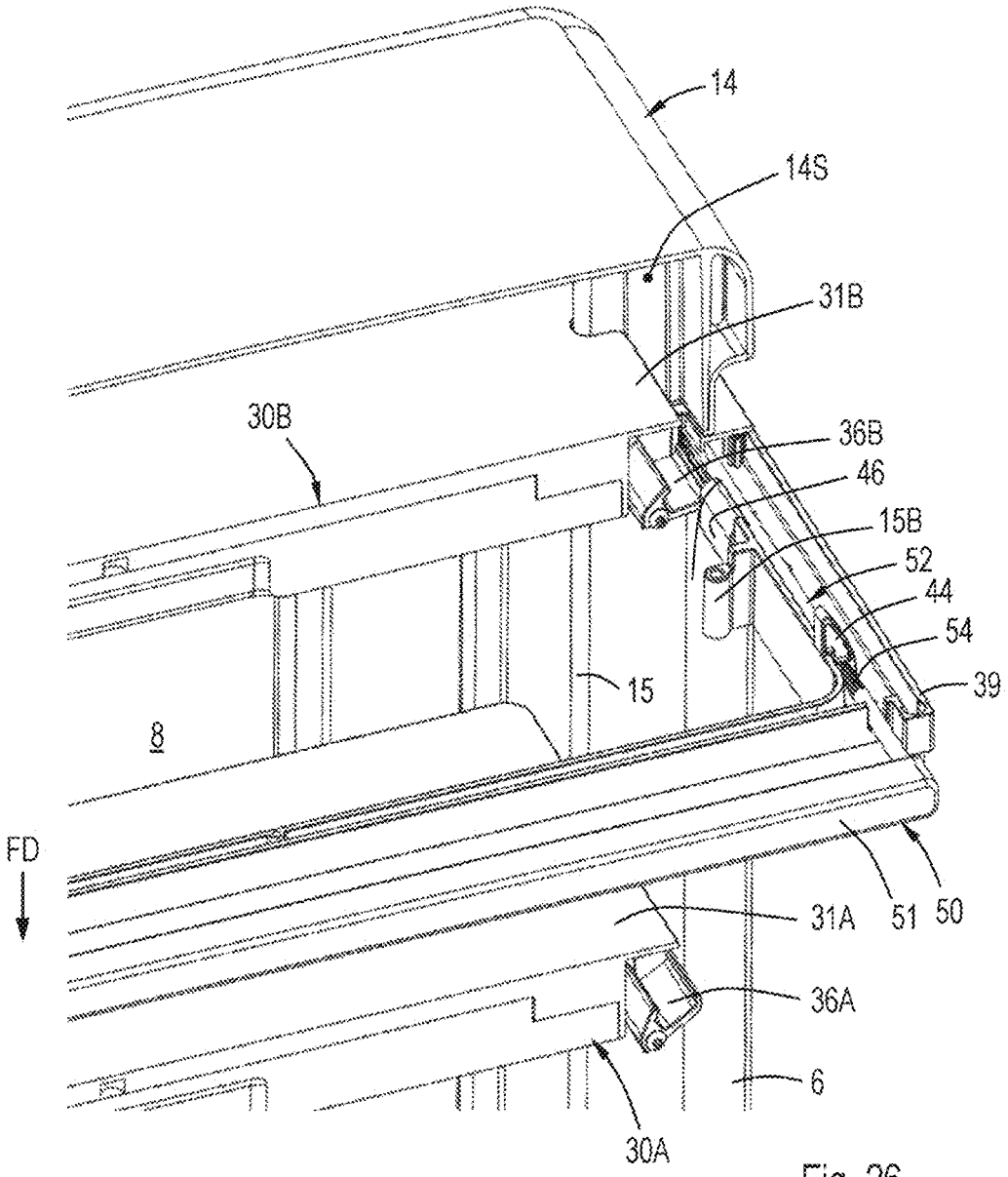
FIG. 26 is a partial cut-away views of the parcel box along section plane B in another use stadium.

However, the shown embodiment comprises another system for authorised unlocking the dividers 30 from the shaft 10 and allowing returning the dividers 30 to the lid 14 in simplified manner. This is indicated in FIGS. 21-24, 25 and 26. FIG. 25 is partial cut-away view of the apparatus 1 along section plane A (cf. FIGS. 17-18). FIG. 26 is a partial cut-away view of the apparatus 1 along section plane B (cf. FIGS. 19-20).

Figure 4:
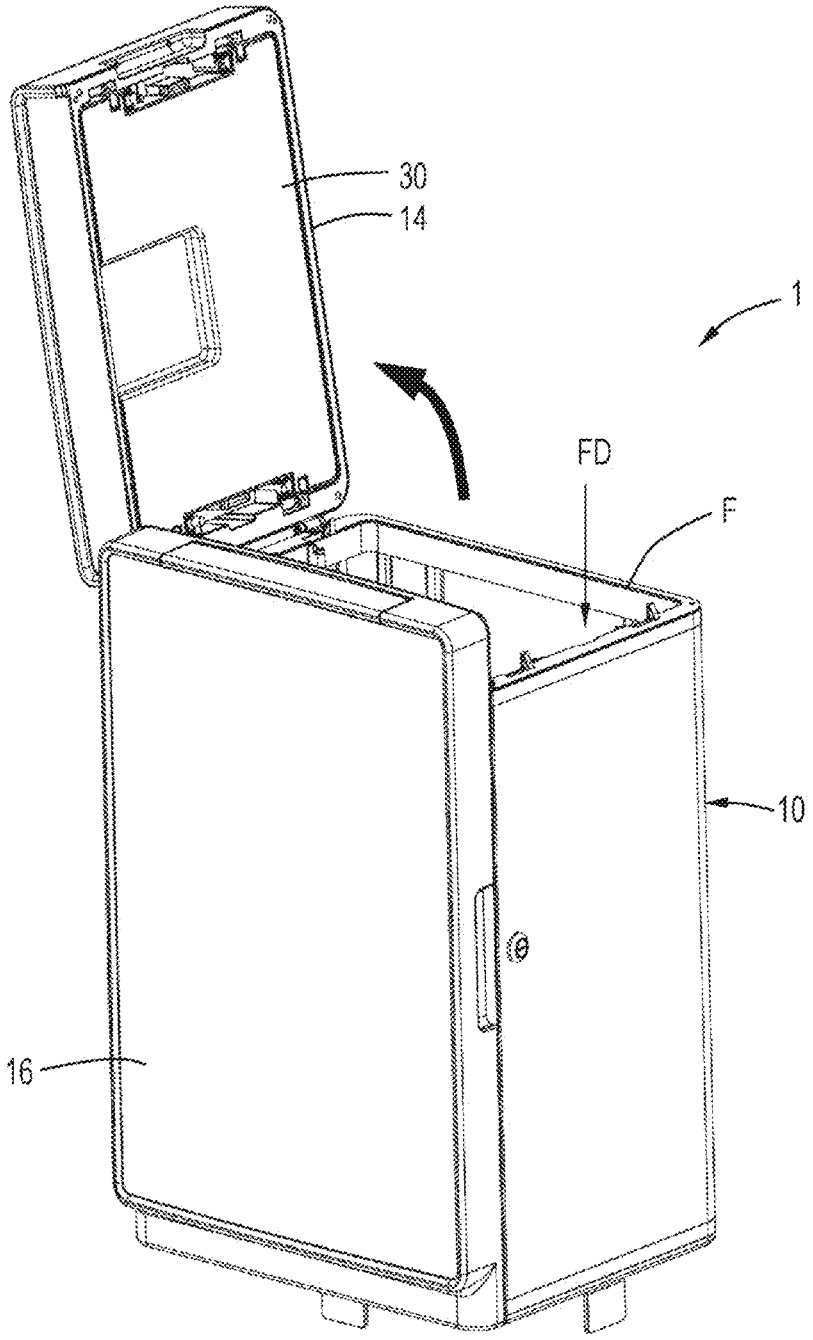
FIGS. 4-12 indicate use and operation steps of the parcel box for receiving parcels.

The shown apparatus comprises an unlocking bracket 50. The bracket 50 is arranged inside the box 1 and is only accessible upon opening the door 16. Thus, access to the bracket 50 is controllable (here, requiring use of the lock 20). FIGS. 21-24 show that after removing any parcels from the apparatus (cf. FIG. 12), the dividers 30 may be moved towards the lid 14. As shown in more detail below, the bracket 50 may be moved, here: pulled out (see arrow), to move the ledges 46 from their respective engagement positions and clear the way for (the latches 36 of) the dividers 30. Then, the dividers 30 may be moved into the lid 14 unhindered. Thereafter the bracket 50 may be returned into position returning the ledges into position and thus preparing the apparatus for receiving new parcels (FIG. 4 and further)

In particular, best seen in FIGS. 25, 26, the apparatus comprises a bracket 50. The bracket 50 is movably accommodated in the rim 39. In the presented embodiment, the bracket 50 is generally U-shaped having a grip portion 51 and two legs 52 bound by a back providing the grip 51 so as to move ledges 46 on both sides of the shaft 10 and allow decoupling the dispensers 30 from (the rails 15 of) the shaft 10 and moving the dividers 30 unhindered back into the dispenser 39. In particular, the ledges 44 are supported on the legs 52, here, the ledges 44 are movable along part 53 of the legs 52 which part may be defined by stops such as here provided by a step edge in a size (e.g.: diameter) of the legs 52; a resilient member, such as here spring 54 is provided to urge the ledge 44 toward a predetermined position along (the part 53 of) the leg 52 (on the left hand side of FIG. 25 the spring 54 is omitted showing that part of the respective leg 52 has a stepwise reduced diameter).

Also, see FIG. 26, the ledges 46 are supported on (the legs 52 of) the bracket 50. The ledges 46 may be fixed to the legs 52.

Moving the bracket 50 with respect to the rim 39, here: pulling the bracket 50 partly out of the rim 39, causes associated movement of the ledges 44 and 46, lateral to the filling direction FD. By this, the ledges 46 are moved from their respective engagement positions (FIGS. 19-20) to another position (FIG. 26) wherein the latch 36B, 36A of a divider 30B, 30A may unhindered pass the ledge 46 and the divider 30B, 30A is unlocked from the shaft 10, so that the divider 30B, 30A can return to the space 14S of the lid 14.

At the same time, the ledges 44 are moved from their respective engagement positions (FIGS. 17-18) to another position (FIG. 25). In this position, the ledges 44 are arranged adjacent the latches 40 of the lid 14, so that the latches 40 may pivot about their respective hinges 41, biased by the springs 42, allowing the dividers 30 to pass the first part 40A of the latches 40 (FIG. 25) and be retained by the latches 40 thereafter in the lid 14 (cf. FIG. 17). Note that although in in FIG. 25 the lid 14 is shown opened for clarity, for restoring the dividers 30 into the dispenser (here: restoring the dividers 30 into the space 14S of) the lid 14 should actually be closed as shown in FIGS. 21-24. A stack of plural dividers 30 may thus be returned to (the space 14S of) the lid 14 as a whole. Therewith, the follower 62 of the lid locking system is moved back from its second position (FIG. 20B) to the its first position (FIG. 20A) so that the latch 63 is freed to move subject to the spring force of the resilient member (spring 64). Thus, the lid locking system is returned from the second configuration (FIG. 20B) into the first configuration (FIG. 20A) and the lid 14 is unlocked from the shaft 10 again for operation.

Figure 24:
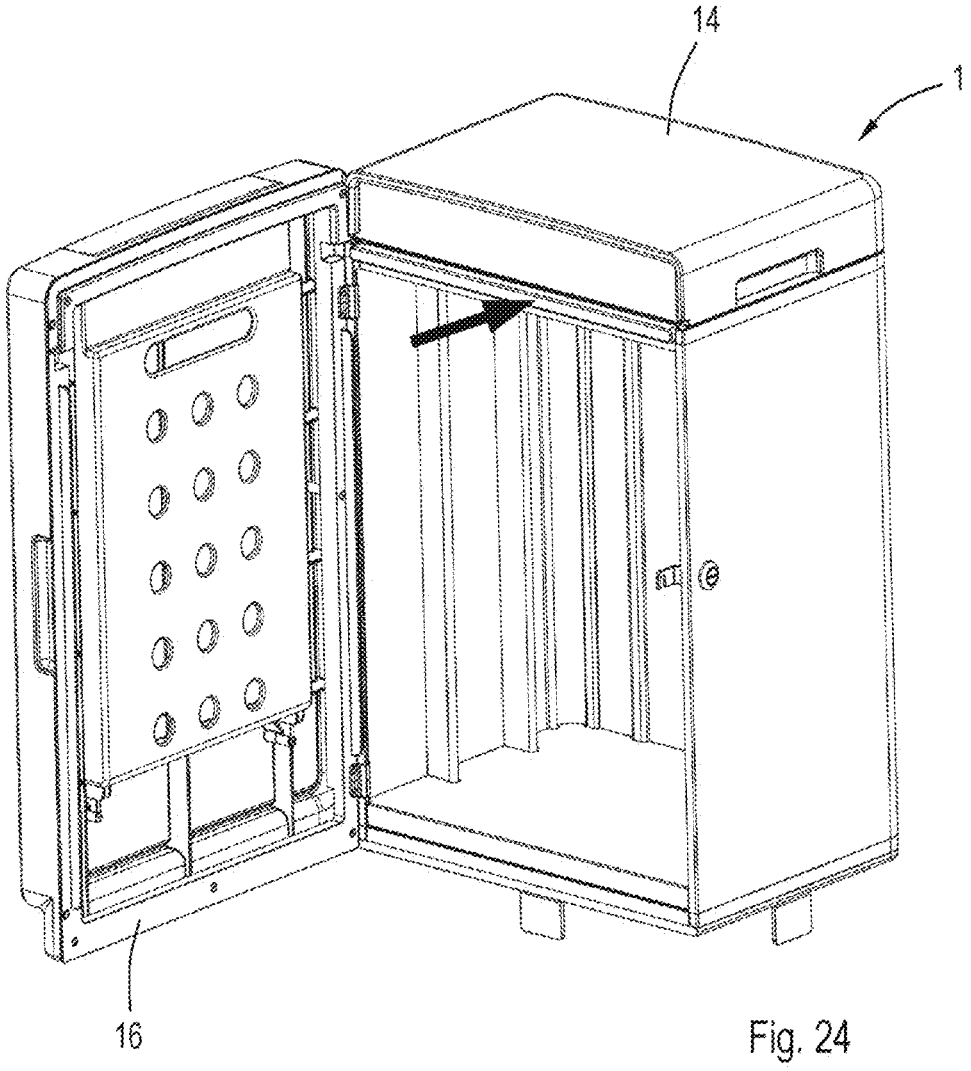

Once the dividers 30 are returned into (the space 14S in) the lid 14, the bracket 50 is pushed back into the rim 39 (FIG. 24). Therewith, the ledges 46 and 36 are aligned again for locking a divider 30 to the shaft 10 (cf. FIG. 19). Also, the ledges 44 are urged laterally against the respective associated latches 40 by the springs 54. Thus arranged laterally adjacent each other, the ledges 44 do not affect the latches 40 engaging and supporting the dividers 30 to retain them in the lid 14.

After returning the bracket 50 to its pushed-in position, the door 16 may be closed and the box 1 is ready again for receiving parcels (FIG. 1, and FIG. 4 and further).

Then, upon opening the lid 14 for the first time after such restoration (FIG. 4), the latches 40 become separated from the ledges 44 so that the ledges 44 are free to return, urged by the springs 54, into operable alignment with the latches 40 for operably engaging the latches 40. Thus, upon closing the lid 14 again thereafter the first divider 30A may be dispensed as discussed above, see FIGS. 7-8 and 17-18.

The disclosure is not restricted to the above-described embodiments which can be varied in a number of ways within the scope of the claims. For instance the box could have a different shape. More or less dividers could be provided. One or more dividers could be provided with a protruding portion, in particular an upward and/or downward protruding rim, to provide a receptacle and/or maintain a minimum separation between portions of adjacent dividers.

Elements and aspects discussed for or in relation with a particular embodiment may be suitably combined with elements and aspects of other embodiments, unless explicitly stated otherwise.

Although the present invention has been described with reference to preferred embodiments, workers skilled in the art will recognize that changes may be made in form and detail without departing from the spirit and scope of the invention.

What is claimed is:

1. An apparatus for one-way filling, the apparatus comprising a tubular filling shaft having a filling end (F) for sequentially receiving parcels (P1, P2, . . . ) in a filling direction (FD) within the shaft;

a plurality of dividers;

wherein each divider is movably lockable or movably locked to the shaft, movable in the filling direction (FD), closes off part of the shaft thereby forming a compartment (C1, C2) for storing a received parcel, and prevents access, at least from the filling end (F) and in the filling direction (FD), to the respective compartment (C1, C2); and a dispenser at said filling end and configured to sequentially dispense the dividers.

2. The apparatus according to claim 1, wherein at least one of the plurality of dividers is movably lockable or locked to the shaft at or near the filling end (F).

3. The apparatus according to claim 1, wherein at least one divider of the plurality of dividers comprise one or more latches and the shaft comprises one or more matching engagement portions for locking the at least one divider to the shaft.

4. The apparatus according to claim 3, wherein the one or more latches allow movement of the at least one divider locked to the shaft in the filling direction (FD) but prevent movement in the opposite direction.

5. The apparatus according to claim 1, wherein movement of the dividers movably locked to the shaft is substantially limited to translation within the shaft, wherein the shaft and dividers comprise one or more cooperating guide structures.

6. The apparatus according to claim 1, wherein the dispenser comprises a lid, wherein opening and closing of the lid, respectively, opens or closes access to the filling end (F).

7. The apparatus according to claim 6, wherein the dispenser is configured for dispensing a divider of the plurality of dividers upon closing of the lid.

8. The apparatus according to claim 6, wherein opening and closing of the lid, respectively, opens or closes access to the filling end (F) in the filling direction (FD).

9. The apparatus according to claim 1, wherein the dispenser is arranged for movably locking a dispensed divider to the shaft.

10. The apparatus according to claim 1, wherein the dispenser comprises a first part configured to hold at least one of the dividers, and a second part comprised by the filling end configured to release the at least one of the dividers held in the first part, wherein the first part comprises first coupling members configured to hold the at least one of the dividers, and the second part comprising first decoupling members configured to decouple the first coupling members.

11. The apparatus according to claim 10 and further comprising a lid, wherein opening and closing of the lid, respectively, opens or closes access to the filling end (F), wherein the lid comprises the first part of the dispenser and the filling end comprises the second part of the dispenser.

12. The apparatus according to claim 11, wherein the dispenser is configured such that in a closed configuration of the lid and the shaft, the first decoupling members decouple the first coupling members.

13. The apparatus according to claim 10, wherein the dividers are arranged in a stack, wherein the first coupling members comprise one or more clamps and/or latches for engaging the at least one of the dividers, and the first decoupling members are configured for engaging and detaching the one or more clamps and/or latches when engaging the at least one of the dividers.

14. The apparatus according to claim 1, and further comprising a system for authorized unlocking the dividers from the shaft.

15. The apparatus according to claim 14, and further comprising a door for accessing at least some of the compartments (C1, C2) and/or at least some of the dividers from another direction than the filling direction (FD), wherein the door provides access to the system for authorized unlocking.

16. The apparatus according to claim 1, wherein the apparatus comprises a bottom closing an end of the shaft opposite to the filling end, the apparatus being formed as a container for stored parcels.

17. The apparatus according to claim 1, and further comprising a door for accessing at least some of the compartments (C1, C2) and/or at least some of the dividers from another direction than the filling direction.

18. An apparatus for one-way filling, the apparatus comprising:

a filling shaft having a filling end (F) for receiving parcels (P1, P2, . . . ), in a filling direction (FD) within the shaft, and at least one divider movably lockable or movably locked to the shaft to be movable in the filling direction (FD), and a dispenser at said filling end configured to dispense a divider of the at least one divider following delivery of a parcel at the filling end, the dispensed divider forming a compartment for storing said parcel.

* * * * *